US011794366B2

(12) United States Patent
Skrobis et al.

(10) Patent No.: US 11,794,366 B2
(45) **Date of Patent: *Oct. 24, 2023**

(54) COATINGS FOR A RAZOR BLADE

(71) Applicant: The Gillette Company LLC, Boston, MA (US)

(72) Inventors: Kenneth James Skrobis, Maynard, MA (US); William Owen Jolley, Spencer, MA (US); John Lawrence Maziarz, Framingham, MA (US); Bin Shen, Shanghai (CN); Ronald Richard Duff, Jr., Shrewsbury, MA (US); Joe David Lussier, Milton, MA (US); Oliver Heinz Claus, Walpole, MA (US); Joseph Allan DePuydt, Salem, NH (US); Jason Scott Slattery, Malden, MA (US); John Joseph Nisby, Hanson, MA (US)

(73) Assignee: The Gillette Company LLC, Boston, MA (US)

( * ) Notice: Subject to any disclaimer, the term of this patent is extended or adjusted under 35 U.S.C. 154(b) by 80 days.

This patent is subject to a terminal disclaimer.

(21) Appl. No.: 17/231,561

(22) Filed: Apr. 15, 2021

(65) Prior Publication Data

US 2021/0323182 A1 Oct. 21, 2021

Related U.S. Application Data

(60) Provisional application No. 63/010,915, filed on Apr. 16, 2020.

(51) Int. Cl.
*B26B 21/60* (2006.01)

(52) U.S. Cl.
CPC ..... *B26B 21/60* (2013.01)

(58) Field of Classification Search
CPC ..... B62B 21/60
(Continued)

(56) References Cited

U.S. PATENT DOCUMENTS 2,244,053 A 6/1941 Comstock
2,703,451 A 3/1955 Struve et al.
(Continued)

FOREIGN PATENT DOCUMENTS

CH 444710 A 9/1967
EP 1397234 A1 3/2004
(Continued)

OTHER PUBLICATIONS

All Office Actions, U.S. Appl. No. 17/231,605.
(Continued)

*Primary Examiner* — Nhat Chieu Q Do
(74) *Attorney, Agent, or Firm* — Kevin C. Johnson; Joanne N. Pappas

(57) ABSTRACT

A razor blade including: a substrate having a tip portion including a tip region, a blade body including a base, and first and second outer sides disposed opposite a split line of the substrate that converge at a tip; and first and second coatings disposed substantially on the first and second outer sides, respectively. Also provided is a method of coating the razor blade, including: applying a first coating to at least a portion of the first outer side; and applying a second coating to at least a portion of the second outer side. The first and second coatings each extend from the tip region toward the base and are substantially different, as compared to each other.

51 Claims, 19 Drawing Sheets

(58) Field of Classification Search
USPC ..... 30/346.54
See application file for complete search history.

(56) References Cited

U.S. PATENT DOCUMENTS

| | | | | |
|---|---|---|---|---|
| 3,861,040 | A | 1/1975 | Dorion, Jr. | |
| 5,232,568 | A * | 8/1993 | Parent | B26B 21/60 204/192.15 |
| 5,295,305 | A | 3/1994 | Hahn et al. | |
| 5,630,275 | A * | 5/1997 | Wexler | B26B 21/54 30/346.54 |
| 6,327,784 | B1 | 12/2001 | Altena et al. | |
| 6,599,178 | B1 | 7/2003 | Gluche et al. | |
| 9,969,094 | B2 | 5/2018 | Hejmowski et al. | |
| 2004/0226176 | A1 | 11/2004 | Peterlin | |
| 2005/0028389 | A1 | 2/2005 | Wort et al. | |
| 2008/0086888 | A1* | 4/2008 | Scheinfeld | B26B 21/60 30/41 |
| 2014/0360021 | A1 | 12/2014 | Sonnenberg et al. | |
| 2017/0136641 | A1* | 5/2017 | Siozios | C23C 14/067 |
| 2017/0341250 | A1 | 11/2017 | Skrobis et al. | |
| 2018/0162000 | A1* | 6/2018 | Duff, Jr. | B26B 21/60 |
| 2018/0264669 | A1 | 9/2018 | Howell | |
| 2021/0094199 | A1 | 4/2021 | Lee et al. | |
| 2021/0323180 | A1 | 10/2021 | Shen et al. | |
| 2021/0323181 | A1 | 10/2021 | Shen et al. | |
| 2021/0323183 | A1 | 10/2021 | Skrobis et al. | |
| 2021/0323184 | A1 | 10/2021 | Skrobis et al. | |

FOREIGN PATENT DOCUMENTS

| | | | | |
|---|---|---|---|---|
| EP | 3828311 | A1 * | 6/2021 | B26B 21/56 |
| WO | WO-0246526 | A1 * | 6/2002 | B05C 11/045 |
| WO | 02100610 | A1 | 12/2002 | |
| WO | 2008065949 | A1 | 6/2008 | |
| WO | 2016079148 | A1 | 5/2016 | |

OTHER PUBLICATIONS

All Office Actions, U.S. Appl. No. 17/231,627.
All Office Actions, U.S. Appl. No. 17/231,579.
All Office Actions, U.S. Appl. No. 17/231,593.
U.S. Unpublished U.S. Appl. No. 17/231,593, filed Apr. 15, 2021, to Kenneth James Skrobis et. al.
U.S. Unpublished U.S. Appl. No. 17/231,579, filed Apr. 15, 2021, to Bin Shen et. al.
U.S. Unpublished U.S. Appl. No. 17/231,605, filed Apr. 15, 2021, to Bin Shen et. al.
U.S. Unpublished U.S. Appl. No. 17/231,627, filed Apr. 15, 2021, to Kenneth James Skrobi et. al.
15680 PCT Search Report and Written Opinion for PCT/US2021/027444 dated Oct. 12, 2021, 13 pages.

* cited by examiner

COATINGS FOR A RAZOR BLADE

FIELD OF THE INVENTION

The invention generally relates to coating of substrates, and more particularly to improved coatings on razor components, such as razor blades.

BACKGROUND OF THE INVENTION

A razor blade is typically formed of a suitable substrate material, such as stainless steel, with a cutting edge formed with a wedge-shaped configuration with an ultimate tip having a radius less than about 1000 angstroms (Å), e.g., about 200-300 Å. One or more hard coatings, such as diamond, amorphous diamond, diamond-like carbon (DLC) material, nitrides, carbides, oxides, or ceramics, may be applied to the substrate material, particularly the cutting edge, to improve strength, corrosion resistance, and shaving ability and to maintain needed strength while permitting thinner edges with lower cutting forces to be used. One or more soft coatings generally of polymeric material, such as polytetrafluoroethylene (PTFE), may be layered on top of the hard coating(s) to impart lubricity and reduce friction. Interlayers of niobium or chromium-containing materials can aid in improving the binding between the substrate, typically stainless steel, and hard carbon coatings, such as DLC, as well as assist in hindering tip rounding. The coatings may be applied using any suitable method, such as Physical Vapor Deposition (PVD) techniques for the hard coating(s) and dipping, spraying, and/or brushing for the soft coating(s). Examples of razor blades and processes of manufacture are described in U.S. Pat. Nos. 5,295,305; 5,232,568; 4,933,058; 5,032,243; 5,497,550; 5,940,975; and 5,669,144; EP 0591339; and PCT 92/03330, which are hereby incorporated by reference.

Conventional blades typically include a generally equal amount of material(s) on both sides of the substrate, often applied by vapor deposition parallel to the cutting edge. The coatings on these blades are highly symmetrical and include a substantially similar composition, coverage area, microstructure, etc. on both sides of the cutting edge. While current razor blades perform adequately, in order for next generation products to perform better, improvements to interactions between the blade and skin and the blade and hair can be made.

SUMMARY OF THE INVENTION

In accordance with an aspect of the present disclosure, a razor blade is provided, which includes: a substrate having a tip portion including a tip region, a blade body including a base, and first and second outer sides disposed opposite a split line of the substrate, in which the first and second outer sides converge at a tip; a first coating disposed substantially on the first outer side and extending from the tip region toward the base; and a second coating disposed substantially on the second outer side and extending from the tip region toward the base, in which the first coating and the second coating are substantially different.

In accordance with another aspect of the present disclosure, a method of coating a razor blade is provided, in which the razor blade includes a substrate having a tip portion including a tip region, a blade body including a base, and first and second outer sides disposed opposite a split line of the substrate, in which the first and second outer sides converge at a tip, the method including: applying a first coating to at least a portion of the first outer side, the first coating extending from the tip region toward the base and being disposed substantially on the first outer side; and applying a second coating to at least a portion of the second outer side, the second coating extending from the tip region toward the base and being disposed substantially on the second outer side, in which the first coating and the second coating are substantially different.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

The term "asymmetric blade," as used herein, means a blade defined by a substrate having a first portion comprising a blade body and a second portion comprising a tip portion wherein a split line passes through a tip of the tip portion, extends through the first and second portions and separates the second portion into generally asymmetric first and second sections. The outer surface of the first section of the second portion is asymmetric with regards to the outer surface of the second section. The outer surface of the first section of the second portion may function as a skin-contacting surface, and the outer surface of the second section may function as a hair-cutting surface.

A "split line," as used herein, means a line extending through the tip of the tip portion of the blade substrate, separates the second portion into asymmetrical first and second sections and is generally parallel with first and second generally parallel outer surfaces of the first portion defining the blade body of the blade substrate.

Figure 1:
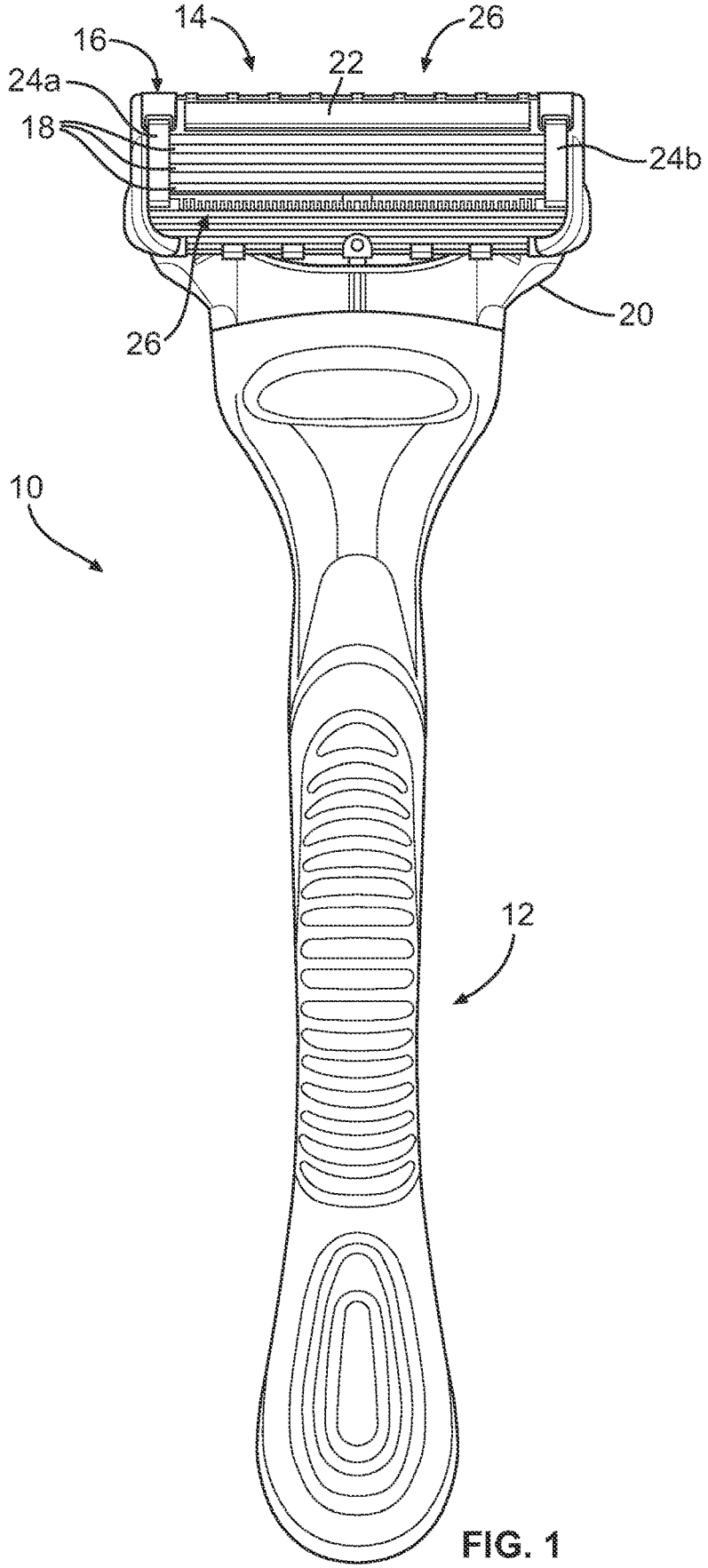
FIG. 1 is a front view of a razor system comprising a handle and a razor cartridge in accordance with the present disclosure.

With reference to FIG. 1, a shaving razor system 10 comprises a handle 12 and a razor cartridge 14. In some examples, the razor cartridge 14 may be detachably mounted to the handle 12 with a connector 20, as shown, and in other examples, the razor cartridge 14 may be attached permanently to the handle 12. The razor cartridge 14 may pivot relative to the handle 12. The razor cartridge 14 may include a cartridge housing 16 having one or more razor blades 18. Although three blades are shown in FIG. 1, it is understood that any number of blades, more or less, may be mounted within the razor cartridge 14. The razor blades 18 may be mounted within the cartridge housing 16 and secured with clips 24*a* and 24*b* as shown. The cartridge housing 16 may further comprise a cap 22 located near a back of the cartridge housing 16 and one or more guard structures 26 located near a front of the cartridge housing 16. The cap 22 may comprise one or more lubrication members (not labeled).

Figure 2:
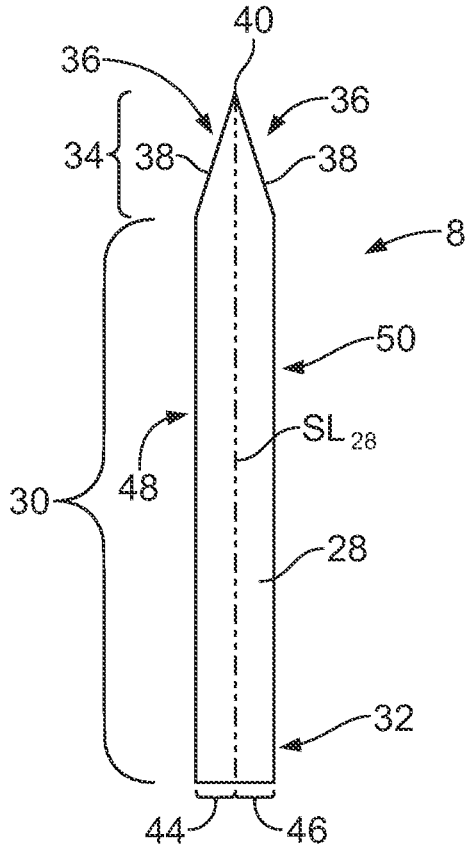
FIG. 2 is a side view of a razor blade with a symmetrical substrate in accordance with the present disclosure.
Figure 3:
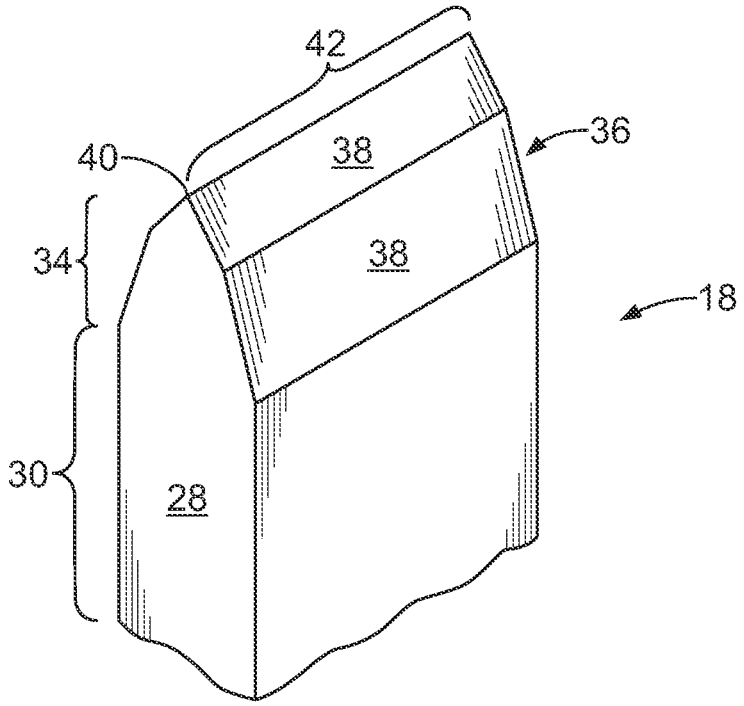
FIG. 3 is a perspective view of a tip portion of another razor blade with a symmetrical substrate in accordance with the present disclosure.
Figure 4:
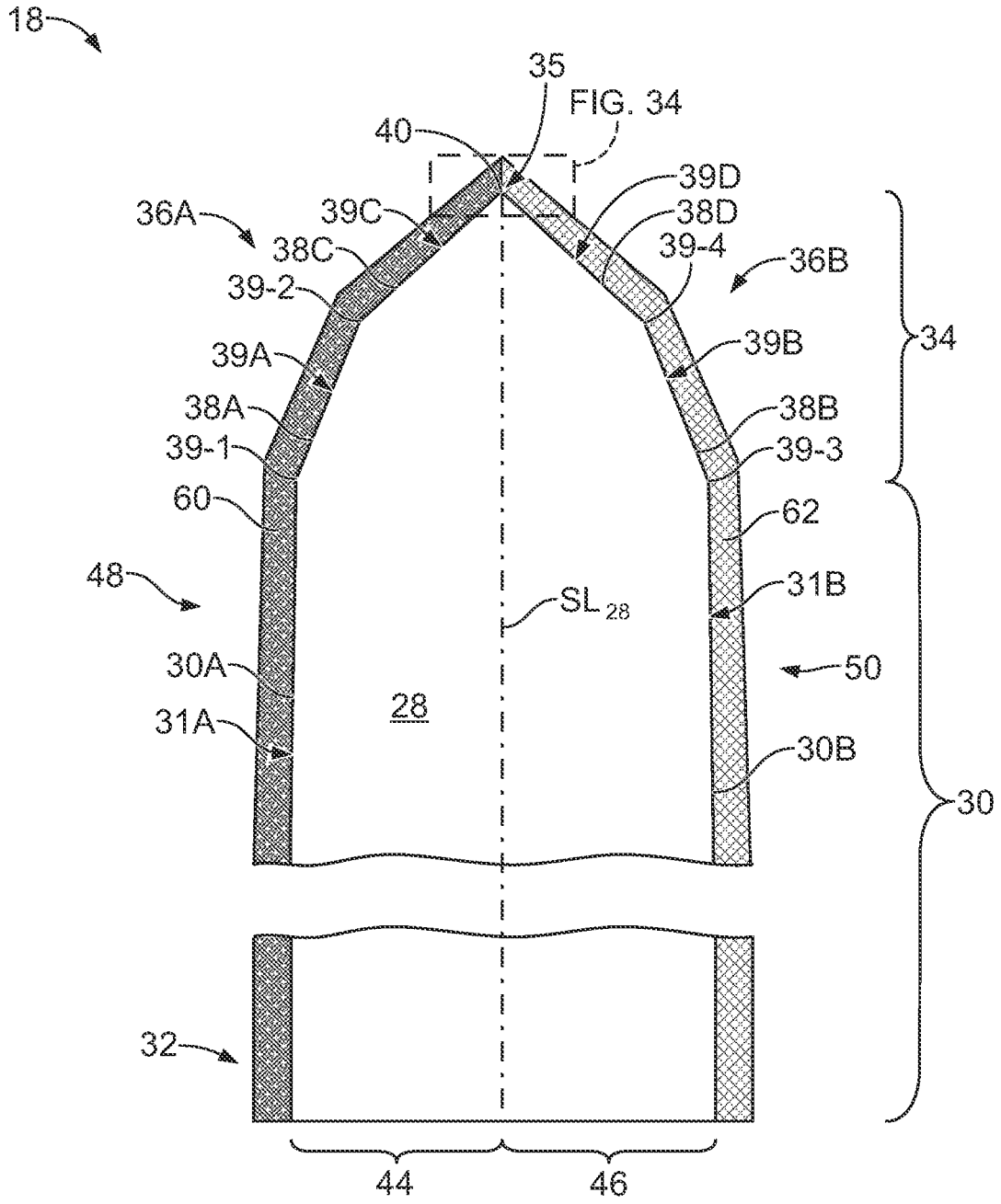
FIGS. 4, 5, 6, 7, 8, 9, 10, 11, 12, 13, 14, 15, 16 and 17 are side views of the tip portion of the razor blade of FIG. 3 comprising one or more coatings in accordance with the present disclosure.

FIG. 2 is a side view of a razor blade 8 in accordance with the present disclosure, and FIGS. 3 and 4 are detailed perspective and side views, respectively, of elements of a razor blade 18 in accordance with the present disclosure. The razor blades 8 and 18 shown in FIGS. 2-4 may each comprise a substrate 28 comprising a first portion with a blade body 30 and a second portion with a tip portion 34. As used herein, a "substrate" signifies the substance or material acted upon by the deposition process(es) in the present disclosure. Illustrative embodiments herein relate to a stainless steel substrate commonly used for razor blade formation. It is contemplated that the substrate of the present invention may also be comprised of other metals, plastic, ceramic, or any other material. The blade body 30 may comprise a base 32, and the tip portion 34 may comprise flanks 36 that converge at a tip 40 to define a cutting edge 42 of the substrate 28, which performs the cutting of hair. The flanks 36 may each comprise one or more bevels or facets 38, as described herein.

In the example illustrated in FIGS. 2-4, the substrate 28 is substantially symmetrical and may comprise a split line $SL_{28}$ that passes through the tip 40 and divides or separates the substrate 28 into substantially equal first and second sections or halves 44 and 46. A first outer side 48 of the substrate 28 is disposed opposite the split line $SL_{28}$ with respect to a second outer side 50. As used herein, the terms "first" and "second" are for reference only and are not intended to be limiting.

At least a portion of one outer side of the substrate 28, e.g., the first outer side 48, may define a skin-contacting surface, and at least a portion of the other outer side, e.g., the second outer side 50, may define a hair-cutting surface. It was determined that the two sides of the razor blade generally perform different functions (e.g., a bottom side that contacts the skin and a top side that performs cutting of the hair, in which both sides perform cutting of the hair with the top side (e.g., away from the skin) having a larger influence). Studies have shown that placing Teflon on one bevel and no Teflon on the other display completely different cutting forces depending on whether the Teflon coated bevel is placed skin side up (e.g., away from the skin) versus skin side down (e.g., closer to the skin). When razor blades with no Teflon coating on one side are placed such that that side (e.g., no Teflon coating) is skin side down, only small cutting force increases were noted when compared to blades having Teflon on both sides, but when razor blades with no Teflon coating are placed skin side up very significant cutting force increases were measured when compared to blades having Teflon on both sides.

With reference to FIG. 4, the tip portion 34 may comprise a first flank 36A defined by a portion of the first outer side 48 and a second flank 36B defined by a portion of the second outer side 50, in which the first and second flanks 36A and 36B converge at the tip 40. The first flank 36A may comprise one or more first facets, e.g., first and third facets 38A and 38C, and the second flank 36B may comprise one or more second facets, e.g., second and fourth facets 38B and 38D. The first facet 38A meets the blade body 30 at a first junction 39-1 and extends between the blade body 30 and the third facet 38C on the first outer side 48 of the substrate 28. The third facet 38C meets the first facet 38A at a second junction 39-2 and extends between the first facet 38A and the tip 40 on the first outer side 48. On the second outer side 50 of the substrate 28, the second facet 38B meets the blade body 30 at a third junction 39-3 and extends between the blade body 30 and the fourth facet 38D. The fourth facet 38D meets the second facet 38B at a fourth junction 39-4 and extends between the second facet 38B and the tip 40 on the second outer side 50. The third and fourth facets 38C and 38D, which may also be referred to as end facets, converge at the tip 40 to define the cutting edge 42. In other examples, the flanks 36 may each include one facet 38 (see the razor blade 8 in FIG. 2) or three or more facets (not shown). In the razor blades 8 and 18 shown in FIGS. 2-4, an outer shape or geometry of the first outer side 48 may be substantially the same as an outer shape or geometry of the second outer side 50. For example, the first facet 38A may substantially correspond to the second facet 38B and may comprise a substantially similar length, as defined between the first and second junctions 39-1 and 39-2 and between the third and fourth junctions 39-3 and 39-4, respectively. The third facet 38C may similarly substantially correspond to the fourth facet 38D and may comprise a substantially similar length, as defined between the tip 40 and the second junction 39-2 and the tip 40 and the fourth junction 39-4, respectively. It follows that the angles at the junctions 39-1 and 39-3, and the angles at the junctions 39-2 and 39-4 may also generally be substantially similar.

With continued reference to FIG. 4, the razor blade 18 may comprise a plurality of outer surfaces, including first and second blade body outer surfaces 31A and 31B defined by outer surfaces of the first and second portions 30A and 30B, respectively, of the blade body 30; and first, second, third, and fourth facet outer surfaces 39A, 39B, 39C, and 39D defined by outer surfaces of the first, second, third, and fourth facets 38A, 38B, 38C, and 38D, respectively. The first outer side 48 of the substrate 28 includes the first blade body outer surface 31A and the first and third facet outer surfaces 39A and 39C. The second outer side 50 includes the second blade body outer surface 31B and the second and fourth facet outer surfaces 39B and 39D. The first and second blade body outer surfaces 31A and 31B may be generally parallel to each other, and the split line $SL_{28}$ may be generally parallel with the first and second blade body outer surfaces 31A and 31B. The first and second outer sides 48 and 50 converge at the tip 40 to define the cutting edge 42 of the substrate 28.

Figure 18:
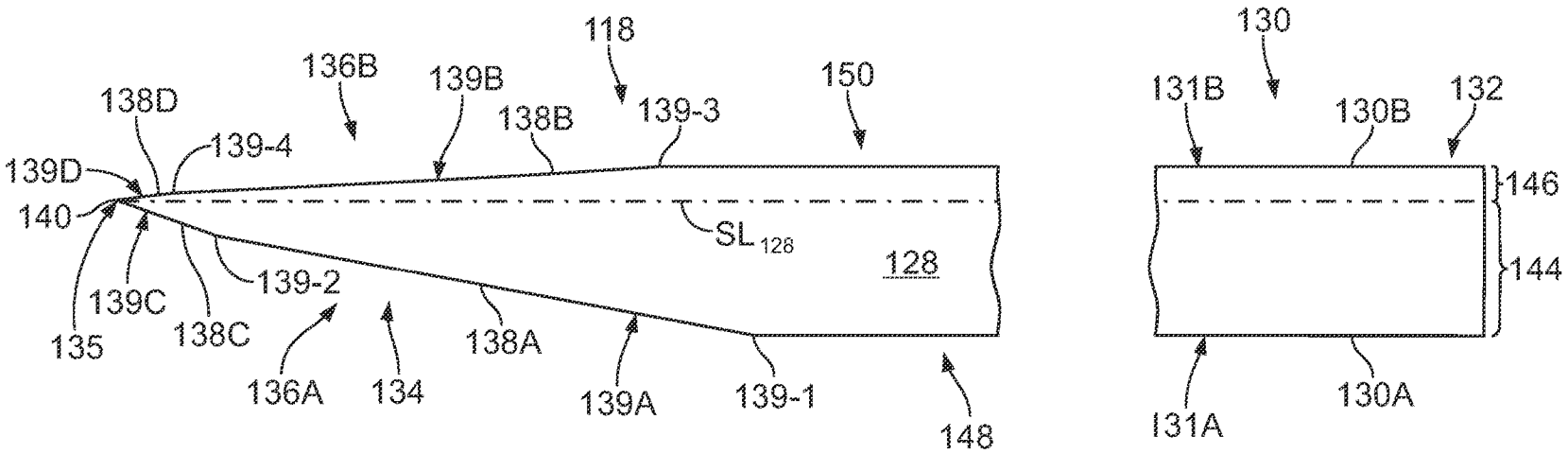
FIG. 18 is a side view of a razor blade with an asymmetrical substrate in accordance with the present disclosure.
Figure 19:
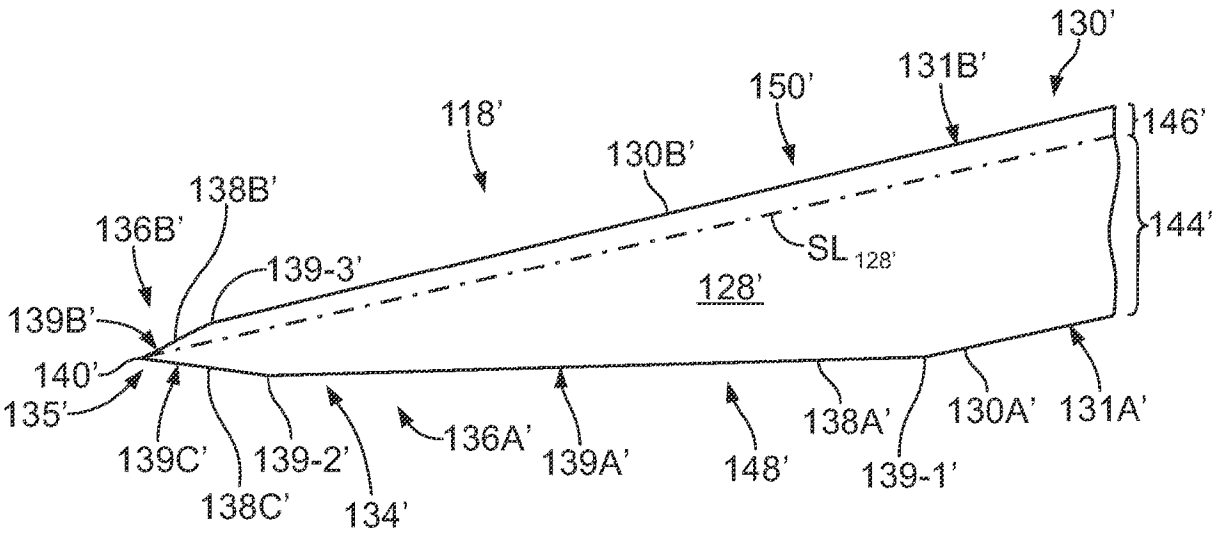
FIG. 19 is a side view of another razor blade with an asymmetrical substrate in accordance with the present disclosure.

FIGS. 18 and 19 are side views illustrating exemplary embodiments of razor blades 118 and 118' in accordance with the present disclosure. Each razor blade 118, 118' may comprise a substrate 128, 128' comprising a first portion comprising a blade body 130, 130' and a second portion comprising a tip portion 134, 134'. The blade body 130, 130' may comprise a base 132 (not shown in FIG. 19), and the tip portion 134, 134' may comprise flanks 136A, 136B and 136A', 136B' that converge at a respective tip 140, 140' to define a cutting edge (not labeled) of the respective substrate 128, 128'. The flanks 136, 136' may each comprise one or more respective bevels or facets, as described herein. The substrates 128, 128' may be asymmetrical, with a split line $SL_{128}$, $SL_{128'}$ that passes through the tip 140, 140'. The split line $SL_{128}$, $SL_{128'}$ is parallel to the blade body outer surfaces 131A and 131B and divides or separates the substrate 128, 128' into asymmetrical first and second sections or halves 144, 144' and 146, 146'. With reference to FIG. 18, a first outer side 148 of the substrate 128 is disposed opposite the split line $SL_{128}$ with respect to a second outer side 150. With reference to FIG. 19, a first outer side 148' of the substrate 128' is disposed opposite the split line $SL_{128'}$ with respect to a second outer side 150'. At least a portion of one outer side of each respective substrate 128, 128', e.g., the first outer side 148, 148', may define a skin-contacting surface, and at least a portion of the other outer side, e.g., the second outer side 150, 150', may define a hair-cutting surface.

In the example shown in FIG. 18, the tip portion 134 of the substrate 128 may comprise a first flank 136A defined by a portion of the first outer side 148 and a second flank 136B defined by a portion of the second outer side 150. The first flank 136A may comprise one or more first facets, e.g., first and third facets 138A and 138C, and the second flank 136B may comprise one or more second facets, e.g., second and fourth facets 138B and 138D. On the first outer side 148 of the substrate 128, the first facet 138A meets the blade body 130 at a first junction 139-1 and extends between the blade body 130 and the third facet 138C; and the third facet 138C meets the first facet 138A at a second junction 139-2 and extends between the first facet 138A and the tip 140. On the second outer side 150 of the substrate 128, the second facet 138B meets the blade body 130 at a third junction 139-3 and extends between the blade body 130 and the fourth facet 138D; and the fourth facet 138D meets the second facet 138B at a fourth junction 139-4 and extends between the second facet 138B and the tip 140. The third and fourth facets 138C and 138D, which may also be referred to as end facets, converge at the tip 140 to define the cutting edge of the substrate 128.

In the example shown in FIG. 19, the tip portion 134' of the substrate 128' may comprise a first flank 136A' defined by a portion of the first outer side 148' and a second flank 136B' defined by a portion of the second outer side 150'. The first flank 136A' may comprise one or more first facets, e.g., first and third facets 138A' and 138C', and the second flank 136B' may comprise one or more second facets, e.g., a second facet 138B'. On the first outer side 148' of the substrate 128', the first facet 138A' meets the blade body 130' at a first junction 139-1' and extends between the blade body 130' and the third facet 138C'; and the third facet 138C' meets the first facet 138A' at a second junction 139-2' and extends between the first facet 138A' and the tip 140'. On the second outer side 150' of the substrate 128', the second facet 138B' meets the blade body 130 at a third junction 139-3' and extends between the blade body 130' and the tip 140'. The second and third facets 138B' and 138C', which may also be referred to as end facets, converge at the tip 140' to define the cutting edge of the substrate 128'.

Because the substrates 128, 128' are asymmetrical, an outer shape or geometry of the first outer side 148, 148' is different from an outer shape or geometry of the second outer side 150, 150'. For example, with reference to FIG. 18, the first facet 138A may comprise a different length, as compared to the second facet 138B, with the lengths being defined between the first and second junctions 139-1 and 139-2 and the third and fourth junctions 139-3 and 139-4, respectively. In some examples, the length of the first facet 138A may be greater than the length of the second facet 138B, and in other examples, the length of the first facet 138A may be less than the length of the second facet 138B. The third facet 138C may similarly comprise a different length, as compared to the fourth facet 138D, with the lengths being defined between the tip 140 and the second junction 139-2 and the fourth junction 139-4, respectively. In some examples, the length of the third facet 138C may be greater than the length of the fourth facet 138D, and in other examples, the length of the third facet 138C may be less than the length of the fourth facet 138D.

With reference to FIG. 19, the first outer side 148' comprises two facets 138A' and 138C', and the second outer side 150' comprises only one facet 138B'. The third facet 138C' may similarly comprise a different length, as compared to the second facet 138B', with the lengths being defined between the tip 140' and the second junction 139-2' and the third junction 139-3', respectively. In some examples, the length of the third facet 138C' may be greater than the length of the second facet 138B', and in other examples, the length of the third facet 138C' may be less than the length of the second facet 138B'.

Each of the razor blades 118, 118' may comprise a plurality of outer surfaces. With reference to FIG. 18, the razor blade 118 comprises first and second blade body outer surfaces 131A and 131B defined by outer surfaces of first and second portions 130A and 130B, respectively, of the blade body 130; and first, second, third, and fourth facet outer surfaces 139A, 139B, 139C, and 139D defined by outer surfaces of the first, second, third, and fourth facets 138A, 138B, 138C, and 138D, respectively. The first and second blade body outer surfaces 131A and 131B may be generally parallel to each other, and the split line $SL_{128}$ may be generally parallel with the first and second blade body outer surfaces 131A and 131B. The first outer side 148 of the substrate 128 includes the first blade body outer surface 131A and the first and third facet outer surfaces 139A and 139C, and the second outer side 150 includes the second blade body outer surface 131B and the second and fourth facet outer surfaces 139B and 139D. The first and second outer sides 148 and 150 converge at the tip 140 to define the cutting edge of the substrate 128. The second and fourth facets 138B and 138D may be located closer to the split line $SL_{128}$ than the first and third facets 138A and 138C, such that the first half 144 of the substrate 128 is larger than the second half 146.

With reference to FIG. 19, the razor blade 118' comprises first and second blade body outer surfaces 131A' and 131B' defined by outer surfaces of the first and second portions 130A' and 130B', respectively, of the blade body 130'; and first, second, and third facet outer surfaces 139A', 139B', and 139C' defined by outer surfaces of the first, second, and third facets 138A', 138B', and 138C', respectively. The first and second blade body outer surfaces 131A' and 131B' may be generally parallel to each other, and the split line $SL_{128'}$ may be generally parallel with the first and second blade body outer surfaces 131A' and 131B'. The first outer side 148' of the substrate 128' includes the first blade body outer surface 131A' and the first and third facet outer surfaces 139A' and 139C', and the second outer side 150' includes the second blade body outer surface 131B' and the second facet outer surface 139B'. The first and second outer sides 148' and 150' converge at the tip 140' to define the cutting edge of the substrate 128'. The second facet 138B' may be located closer to the split line $SL_{128'}$ than the first and third facets 138A' and 138C', such that the first half 144' of the substrate 128' is larger than the second half 146'.

Razor blades in accordance with the present disclosure may comprise a coating disposed substantially on the outer sides of the razor blade. A "layer" as used herein may signify at least one material on a razor blade satisfied by a variety of factors, including but not limited to, the composition, morphology, or structure of the layer(s); the presence of a boundary between layers; whether the process used to make the product is expected to result in one or more layers; and whether there is a sufficient change in composition or morphology as to result in one or more layers. As one example, there may be only one type of material on the razor blade but with distinguishable layers, each layer having a different morphology. As used herein, a "coating" may signify one or more layers on a razor blade, in which each layer comprises one or more materials. Thus, the present invention "coating" may be defined by a single layer or by multiple layers. The present invention also contemplates the term "coating" to signify the overall or total coating on one side of the razor blade, which includes all of the layers on that one side of the razor blade.

In particular, a "coating" as used herein includes all layer(s) of material(s) applied to one outer side of the razor blade. For example, a coating may include one or more layers as defined herein, such as a first layer that is disposed substantially on a portion or the entirety of one outer side of the razor blade; a second layer that is formed on top of at least a portion of the first layer; a third layer that is formed on top of at least a portion of the second layer; and so on. A coating may further include a plurality of sections that are disposed substantially on one outer side of the razor blade, wherein each section may comprise one or more layers of material(s). For example, the coating may comprise a first section that extends substantially from a first point or location on one outer side of a razor blade to a second point or location on the one outer side; a second section that extends substantially from the second point or location to a third point or location on the one outer side; a third section that extends substantially from the third point or location to a fourth point or location on the one outer side; and so on, in which each section is substantially different from an adjacent section, as described in detail herein.

As used herein to, the phrases "disposed substantially on," "extending substantially from," and similar phrases are used to describe a location or position of each coating, including one or more layers and/or sections thereof, and signifies that a majority of the coating/layer/section is disposed on an indicated outer side and/or surface(s) of the razor blade and/or that a majority of the coating/layer/section extends between two indicated points or locations on the outer side and/or surface(s) of the razor blade. As described herein with respect to FIGS. 34-37, these phrases may encompass structures in which a portion of the coating/layer/section extends over the tip and onto the other outer side or surface; overlaps onto an adjacent outer side or surface; extends slightly beyond the two indicated points or locations on the surface; or extends slightly past, or stops slightly short of, an identified junction between adjacent facets or between the blade body and a facet.

In accordance with the present disclosure, a coating on one outer side of a razor blade is substantially different as compared to a coating on the other outer side of the razor blade. FIGS. 4-17 illustrate exemplary coatings with respect to an asymmetrical razor blade 18 having a symmetrical substrate 28, and FIGS. 20-33 illustrate exemplary coatings with respect to an asymmetrical razor blade 118 having an asymmetrical substrate 128. Some labeling in FIGS. 5-17 and 20-33 is removed to illustrate other aspects of the structure in detail.

As used herein, the terms "symmetrical," "asymmetrical," and derivatives thereof may refer to an outer shape of a substrate that defines a razor blade and/or to coating(s) formed thereon, as determined with respect to a split line of the substrate. For example, the substrate 28 in FIG. 4 is substantially symmetrical (i.e., the split line $SL_{28}$ divides the substrate 28 into substantially equal sections/halves 44 and 46 with substantially similar outer shapes that are generally mirror images of each other), but the coating(s) formed on the substrate 28 in accordance with the present disclosure are asymmetrical (i.e., the coating formed on outer side 48 is different from the coating formed on outer side 50, as described herein in detail), such that the razor blade 18 is asymmetrical. The substrate 128 in FIG. 18 and the coatings formed thereon are both asymmetrical, as described herein, such that the razor blade 118 is asymmetrical.

Figure 5:
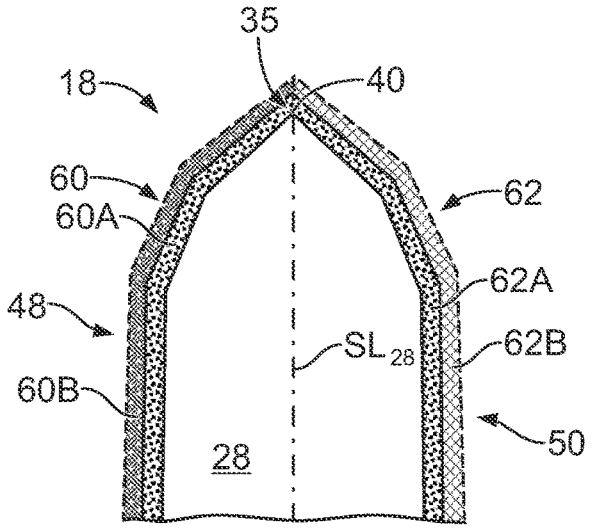
Figure 6:
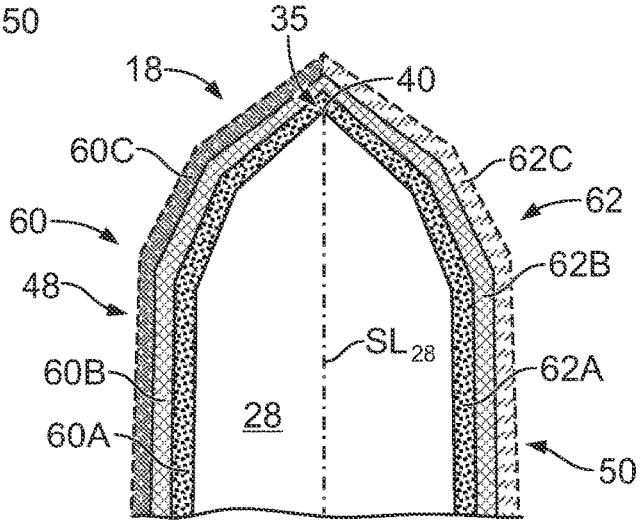
Figure 34:
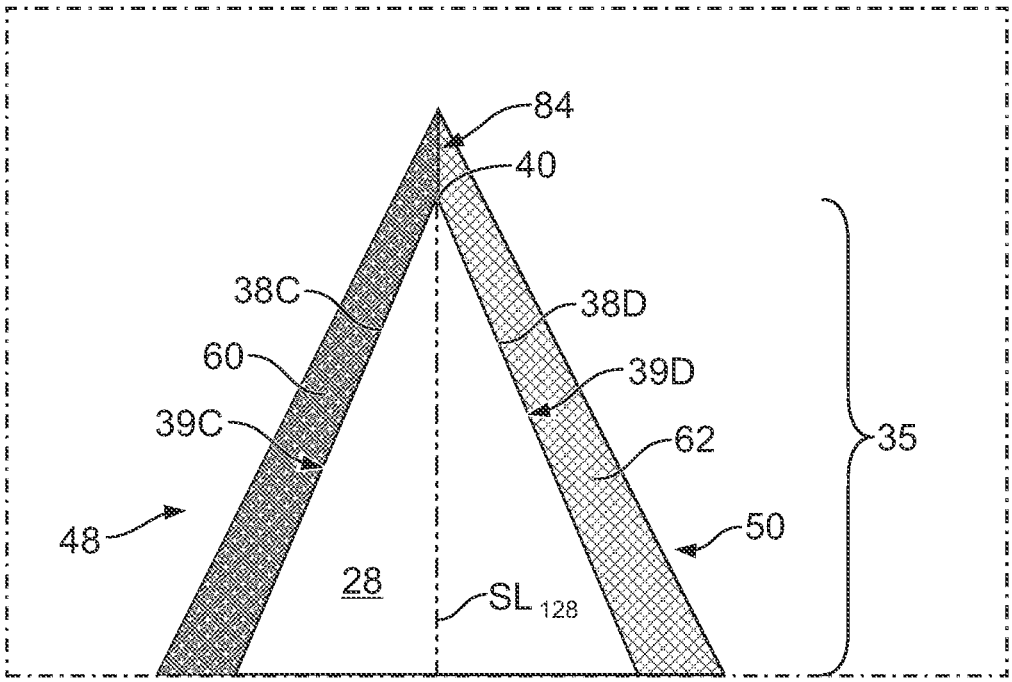
FIG. 34 is a detailed side view of a tip region of the razor blade of FIGS. 4 and 20.

As shown in FIGS. 4-6, the razor blade 18 may comprise a first coating 60 disposed substantially on the first outer side 48 of the substrate 28 and a second coating 62 disposed substantially on the second outer side 50 of the substrate 28. In some examples, the first and second coatings 60 and 62 may each comprise a single layer of material, as shown in FIG. 4. In other examples, at least one of the first or the second coating 60 and 62 may comprise a plurality of layers of material(s), as shown in FIGS. 5 and 6 and described in detail herein. The first and the second coatings 60 and 62 extend from a tip region 35 toward the base 32 (see FIG. 4) along the respective first and second outer sides 48 and 50 of the substrate 28. As shown in FIG. 4, the tip portion 34 of the substrate 28 comprises the tip region 35, in which the tip region 35 encompasses, i.e., includes, the tip 40 plus a portion of the substrate 28 extending from the tip 40 toward the base 32 by about 1 μM along the first and second outer sides 48 and 50, as shown in FIG. 34.

With reference to FIGS. 5 and 6, in some embodiments one or both of the first and second coatings 60 and 62 may comprise a plurality of layers of material(s), and a difference between the first and second coatings 60 and 62 may be a number of layers of material(s) on each outer side 48 and 50 of the substrate 28. In some aspects, the first coating 60 may comprise a first number of layers, and the second coating 62 may comprise a second number of layers that is different from the first number of layers. As shown in FIG. 5, the first coating 60 may comprise at least one of first or second layers 60A and 60B, and the second coating 62 may comprise at least one of third or fourth layers 62A and 62B, in which the second layer 60B is formed on top of at least a portion of the first layer 60A and the fourth layer 62B is formed on top of at least a portion of the third layer 62A. In some examples, the first outer side 48 of the substrate 28 in FIG. 5 may comprise the first coating 60 with two layers 60A and 60B, and the second outer side 50 may comprise the second coating 62 with fewer layers (e.g., only the third layer 62A, as illustrated with the fourth layer 62B shown in dashed lines on the righthand side in FIG. 5 indicating that the fourth layer 62B is optional). In further examples, the second outer side 50 in FIG. 5 may comprise two layers 62A and 62B, and the first outer side 48 may comprise the first coating 60 with fewer layers (e.g., only the first layer 60A, as illustrated with dashed lines on the lefthand side of FIG. 5).

With reference to FIG. 6, the first coating 60 may comprise at least one of first, second, or third layers 60A-60C, and the second coating 62 may comprise at least one of fourth, fifth, or sixth layers 62A-62C, in which the second layer 60B is formed on top of at least a portion of the first layer 60A, the third layer 60C is formed on top of at least a portion of the second layer 60B, the fifth layer 62B is formed on top of at least a portion of the fourth layer 62A, and the sixth layer 62C is formed on top of at least a portion of the fifth layer 62B. In some examples, the first outer side 48 of the substrate 28 in FIG. 6 may comprise the first coating 60 with three layers 60A-60C, and the second outer side 50 may comprise the second coating 62 with fewer layers (e.g., only the fourth and fifth layers 62A and 62B, as illustrated with the sixth layer 62C shown in dashed lines on the righthand side of FIG. 6 indicating that the sixth layer 62C is optional, or only the fourth layer 62A). In further examples, the second outer side 50 in FIG. 6 may comprise the second coating 62 with three layers 62A-62C, and the first outer side 48 may comprise the first coating 60 with fewer layers (e.g., only the first and second layers 60A and 60B, as illustrated with the third layer 60C shown in dashed lines on the lefthand side of FIG. 6 indicating that the third layer 60C is optional, or only the first layer 60A).

In other embodiments, with reference to FIGS. 4-6, a difference between the first and second coatings 60 and 62 may be the material(s) comprising each coating 60 and 62 and/or one or more layers 60A-60C and/or 62A-62C thereof. For example, the first coating 60 may comprise one or more first materials, and the second coating 62 may comprise one or more second materials, in which at least one second material is different from at least one first material. The difference in materials may be used alone or in combination with a difference in the number of layers 60A-60C and 62A-62C formed on the first and second outer sides 48 and 50 of the substrate 28. For example, the first coating 60 may comprise a same number of layers as the second coating 62 (e.g., coatings 60 and 62 with one layer in FIG. 4; two layers 60A, 60B and 62A, 62B in FIG. 5; or three layers 60A-60C and 62A-62C in FIG. 6) or a different number of layers, as described herein, with at least one second material being different from at least one first material.

In examples in which one or both outer sides 48 and 50 of the substrate 28 comprise two or more layers 60A-60C and/or 62A-62C as shown in FIGS. 5 and 6, the layer(s) 60A-60C on the first outer side 48 may comprise one or more material(s) that are the same as, or different from, the material(s) forming the layer(s) 62A-62C on the second outer side 50 and may be applied in any desired combination, so long as the first coating 60 is substantially different from the second coating 62. For instance, with reference to FIG. 5, the first and third layers 60A and 62A may comprise a first (same) material; the second layer 60B may comprise a second material that is different from the first material; and the fourth layer 62B may comprise a third material that is different from the first and second materials. In other examples, the first and third layers 60A and 62A in FIG. 5 may comprise different materials (as compared to each other), and the second and fourth layers 60B and 62B may comprise the same material. With reference to the three-layer example depicted in FIG. 6, the first and fourth layers 60A and 62A may comprise a first (same) material; the second and fifth layers 60B and 62B may comprise a second (same) material that is different from the first material; the third layer 60C may comprise a third material that is different from the first and second materials; and the sixth layer 62C may comprise a fourth material that is different from the first, second, and third materials. In further examples, all of the layers 60A-60C and/or 62A-62C in FIGS. 5 and 6 may comprise different materials.

The materials may comprise one or more carbon-containing materials (e.g., diamond, amorphous diamond, nanocrystalline diamond, or diamond like carbon (DLC)); nitrides (e.g., boron nitride, niobium nitride, chromium nitride, titanium nitride, aluminum titanium nitride, titanium carbon nitride), carbides (e.g., silicon carbide or chromium carbide), oxides (e.g., alumina, zirconia), titanium diboride, one or more ceramic materials, a fluorinated polymer (e.g., polytetrafluoroethylene (PTFE)), a polyolefin (e.g., polypropylene), niobium, chromium, and platinum chromium. The carbon-containing materials can be doped with other elements, such as tungsten, titanium, or chromium by including these additives, for example, in the target during application by sputtering. The materials can also incorporate hydrogen, e.g., hydrogenated DLC. The materials may comprise one or more nanocomposites such as carbon-based nanocomposites, metal-matrix nanocomposites, and/or ceramic-matrix nanocomposites; e.g., diamond and carbon and nanocomposites.

In one example, the first material may comprise DLC, and the second material may comprise platinum chromium. In another example, the first material may comprise a metal, and the second material may comprise a ceramic. In further examples, one or both of the first or the second coating 60 and 62 may comprise one or more layers with niobium. In some aspects, the first coating 60 may comprise a layer 60A comprising one of platinum chromium, chromium nitride, or chromium carbide; and the second coating 62 may comprise a layer 62A of niobium disposed substantially on the second outer side 50 of the substrate 28, a layer 62B (also referred to herein as a hard coating layer) of DLC disposed on at least a portion of the layer 62A of niobium, and a layer 62C (also referred to herein as an overcoat layer) of chromium disposed on at least a portion of the hard coating layer 62B. In other aspects, the first coating 60 may comprise a layer 60A of niobium disposed substantially on the first outer side 48 of the substrate 28, a hard coating layer 60B of DLC disposed on at least a portion of the layer 60A of niobium, and an overcoat layer 60C of chromium disposed on at least a portion of the hard coating layer 60B; and the second coating 62 may comprise a layer 62A of niobium disposed substantially on the second outer side 50 of the substrate 28, a hard coating layer 62B of DLC disposed on at least a portion of the layer 62A of niobium, and an overcoat layer 62C of niobium disposed on at least a portion of the hard coating layer 62B.

The material(s) comprising the first and second coatings 60 and 62 may be selected based, at least in part, on a coefficient of friction of the material(s). For example, the first coating 60 may comprise a first material with a first coefficient of friction and the second coating 62 may comprise a second material with a second coefficient of friction that is different from the first coefficient of friction. In some aspects, the first coating 60 may comprise a material with a lower coefficient of friction such as PTFE, particularly when the first outer side 48 of the substrate 28 defines the skin-contacting surface, and the second outer side 50 of the substrate 28 may comprise a second coating 62 with a higher coefficient of friction (as compared to the first material). For example, the second coating may lack PTFE or may comprise a material such as polypropylene with a higher coefficient of friction than PTFE.

The first coating 60 may comprise a first morphology, and the second coating 62 may comprise a second morphology that is different from the first morphology. For instance, the first morphology may comprise a first microstructure and the second morphology may comprise a second microstructure. The microstructure may include, for example, an amorphous microstructure or a columnar or crystalline microstructure. In some examples, the microstructure may be dense or porous, in which a porous microstructure may improve adhesion of a polymer coating. In some aspects, the first coating 60 may comprise a material with one morphology, and the second coating 62 may comprise the same material with a different morphology. In other aspects, the first and second coatings 60 and 62 may comprise different materials with different morphologies. The desired morphology may be obtained, for example, by applying the coatings 60 and 62 via different application techniques or via the same application technique with differing application speeds, as described herein.

The first coating 60 may comprise a first texture, and the second coating 62 may comprise a second texture that is different from the first texture. For instance, the first texture may comprise a substantially smooth texture, particularly where the first outer side 48 of the substrate 28 defines the skin-contacting surface, and the second texture may comprise a discontinuous or coarse texture which may include protrusions. The desired texture may be obtained by, for example, applying the coatings 60 and 62 via different application techniques or via the same application technique with differing application speeds, as described herein. The texture may also be altered via one or more post-application treatment methods, as described herein.

The material(s) comprising the first and second coatings 60 and 62 may be selected based, at least in part, on a hardness of the material(s). The first coating 60 may comprise a first hardness, and the second coating 62 may comprise a second hardness that is different from the first hardness. In some examples, the first hardness may be greater than about 7 GPa, and the second hardness may be greater than about twice the first hardness, e.g., greater than about 15 GPa. In other examples, the first hardness may be between about 7 GPa to about 10 GPa, and the second hardness may be between about 15 GPa to about 60 GPa. As used herein with respect to hardness, the term "about" may mean ±0.5 GPa.

Figure 16:
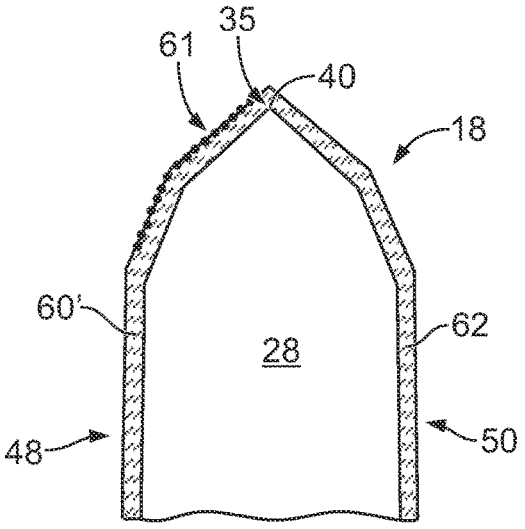
Figure 32:
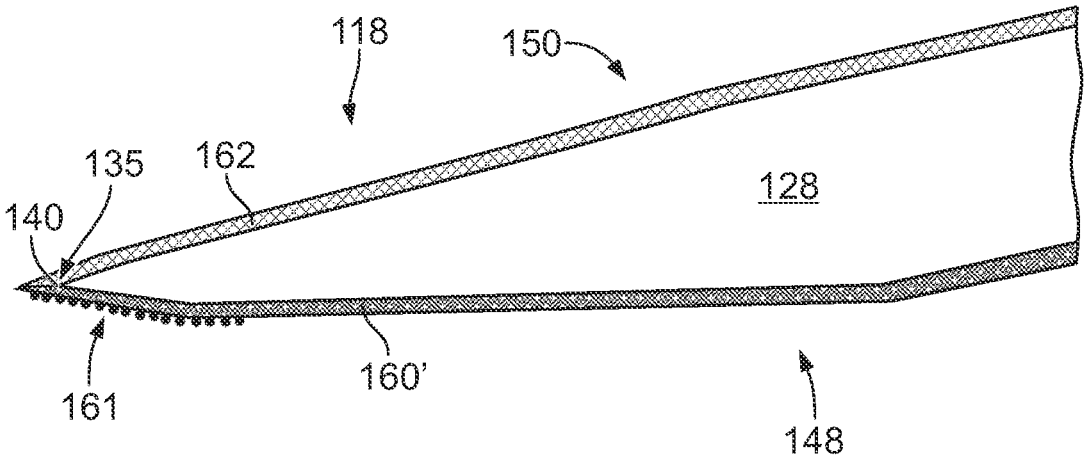

In further examples, at least a section of the first and/or the second coating may be subjected to one or more post-application treatments (e.g., modification of a surface of the coating and/or modification of one or more layers of the coating). For instance, one or more sections of the first and/or second coating may be subjected to ion implantation. With reference to FIGS. 16 and 32, at least a section of one coating, e.g., the first coating 60'/160', may comprise an ion-implanted material 61/161, and the other coating, e.g., the second coating 62/162 may comprise a non-ion-implanted material. In some aspects, the first and second coatings 60'/160' and 62/162 may comprise a same base material, in which only one coating, i.e., the first coating 60'/160', is subjected to ion implantation. In other aspects, the first and second coatings 60'/160' and 62/162 may comprise at least one different material. In further aspects, at least a section of the first and second coatings 60'/160' and 62/162 may both be subjected to ion implantation with a same or different ion. The ion-implanted material 61, 161 may comprise, for example, a plasma-nitrided material or a plasma-borided material. The ion implantation may be performed as described herein and may be performed on all or part of the first and/or second coatings 60'/160' and 62/162.

The one or more post-application treatments may also comprise altering a texture of at least a section of the first and/or second coating. For example, one or more sections of the first and/or second coating may be subjected to chemical modification (e.g., solvent treatment) and/or mechanical modification (e.g., ion etching, ion implantation, abrading, rubbing, polishing, etc.) to alter a surface texture of the one or more sections.

The one or more post-application treatments may further comprise partially removing one or more portions of the first and/or second coating, e.g., by solvent treatment, ion etching, etc. Partial removal may comprise, for example, removal of all or part of a thickness of the first and/or second coating (i.e., in a direction substantially perpendicular to an underlying portion of the substrate) along one or more sections of the first and/or second coating, in which at least a portion of the first and/or second coating remains intact. In some examples, the partial removal of the one or more portions of the first and/or second coating may be followed by one or more additional post-application treatments comprising selectively applying material to the first and/or second coating from which material was partially removed. The selectively-applied material may be applied using any suitable method. The selectively-applied material may comprise, for example, a polymer or an organic compound, such as a fluropolymer, PTFE, or polypropylene. In some particular examples, the portion(s) of the first and/or second coating to which material is selectively applied may define a skin-contacting surface of the razor blade.

Figure 7:
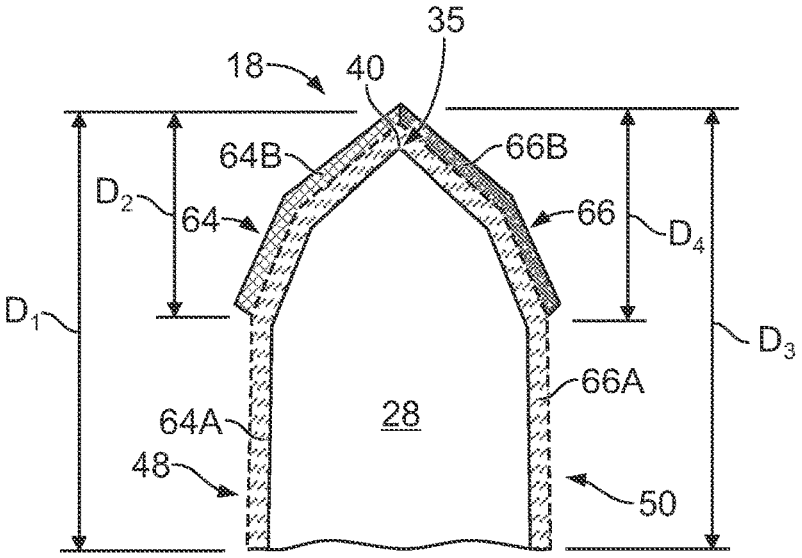

In the examples shown in FIGS. 4-6, the coating(s) 60 and 62 and layer(s) 60A-60C and 62A-62C thereof are depicted as extending along the respective first or second outer side 48 and 50 of the substrate 28 from the tip region 35 onto the blade body 30, and in some instances, all the way to the base 32 of the razor blade 18 as shown in FIG. 4. In other examples, the coatings and/or one or more layers thereof may stop short of the blade body 30 and/or the base 32. With reference to FIG. 7 and the labeling of the substrate 28 in FIG. 4, the substrate 28 may comprise coatings 64 and 66 and/or one or more layers thereof that are disposed substantially only on the tip portion 34 of the substrate 28, e.g., on one or more of the facets 38A-38D. For instance, the first coating 64 may comprise one or more layers including a first layer 64A that is disposed substantially on, and extends along a portion of, the first outer side 48 of the substrate 28 from the tip region 35 toward the base 32 for a first distance $D_1$; and a second layer 64B that is formed on top of at least a portion of the first layer 64A and extends from the tip region 35 toward the base 32 for a second distance $D_2$. The second coating 66 may comprise one or more layers including a third layer 66A that is disposed substantially on, and extends along a portion of, the second outer side 50 of the substrate 28 from the tip region 35 toward the base 32 for a third distance $D_3$; and a fourth layer 66B that is formed on top of at least a portion of the third layer 66A and extends from the tip region 35 toward the base 32 for a fourth distance $D_4$.

In the example shown in FIG. 7, the first and third distances $D_1$ and $D_3$ may be substantially the same and the second and fourth distances $D_2$ and $D_4$ may be substantially the same. In some aspects, the second and fourth distances $D_2$ and $D_4$ may be less than the respective first and third distances $D_1$ and $D_3$. For instance, with reference to FIG. 7 and the labeling of the substrate 28 in FIG. 4, the first and third layers 64A and 66A may each extend along the respective first or second outer sides 48 and 50 from the tip region 35 onto the blade body 30 and toward the base 32;

and the second and fourth layers 64B and 66B may be disposed substantially on the facets 38A-38D, with the second layer 64B extending from the tip region 35 to about the first junction 39-1 between the first facet 38A and the blade body 30 and the fourth layer 66B extending from the tip region 35 to about the third junction 39-3 between the second facet 38B and the blade body 30. In other aspects, the first and second coatings 64 and 66 may each comprise only a single layer, e.g., layers 64B and 66B (with the first and third layers 64A and 66A shown in dashed lines in FIG. 7 indicating that they are optional), that are disposed substantially on the respective first or second outer sides 48 and 50 and may comprise substantially the same features as described above. In further examples (not shown), the layers 64B and 66B may be formed only on the second and fourth facets 38B and 38D (with or without the layers 64A and 66A), with the second layer 64B extending from the tip region 35 to about the second junction 39-2 between the first and second facets 38A and 38B and the fourth layer 66B extending from the tip region 35 to about the fourth junction 39-4 between the second and fourth facets 38B and 38D. In all examples in FIG. 7, as compared to each other, the layers 64B and 66B comprise a different material, and when present, the layers 64A and 66A may comprise a same or different material, as described herein.

Figure 8:
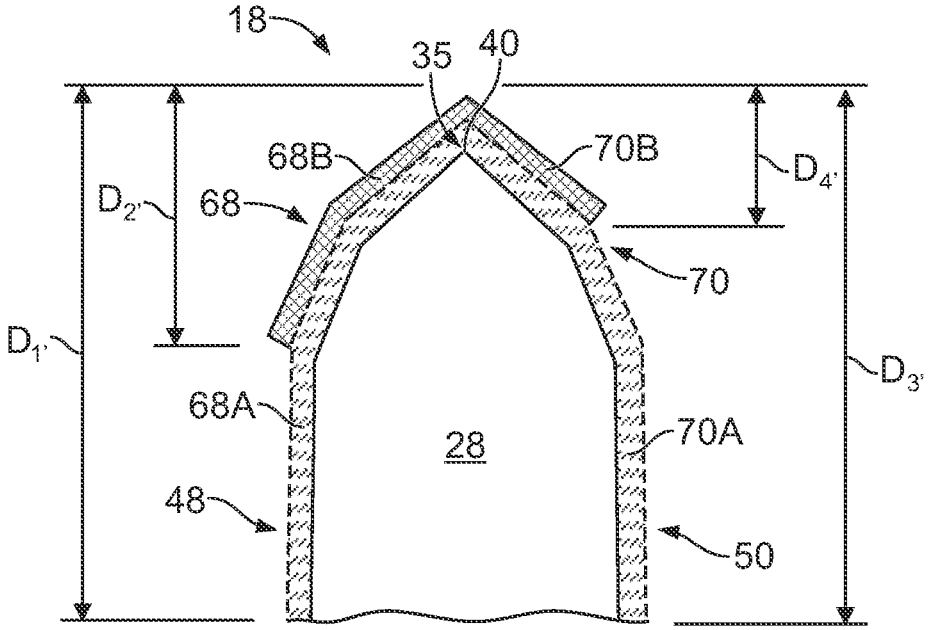

With reference to FIG. 8, in further embodiments, a difference between a first and a second coating 68 and 70 may be a distance by which the coatings 68 and 70, or one or more layers 68A, 68B, 70A, and 70B thereof, extend along the respective first or second outer side 48 and 50 of the substrate 28. This difference may be used alone or in combination with a difference in materials, as described herein. The first coating 68 may comprise a first layer 68A that is disposed substantially on, and extends along a portion of, the first outer side 48 of the substrate 28 from the tip region 35 toward the base (not shown; see base 32 in FIG. 4) for a first distance $D_{1'}$; and a second layer 68B that is formed on top of at least a portion of the first layer 68A and extends from the tip region 35 toward the base for a second distance $D_{2'}$. The second coating 70 may comprise a third layer 70A that is disposed substantially on, and extends along a portion of, the second outer side 50 of the substrate 28 from the tip region 35 toward the base for a third distance $D_{3'}$; and a fourth layer 70B that is formed on top of at least a portion of the third layer 70A and extends from the tip region 35 toward the base for a fourth distance $D_{4'}$.

In the example depicted in FIG. 8, the second distance $D_{2'}$ is different from the fourth distance $D_{4'}$. For instance, the fourth distance $D_{4'}$ may be less than the second distance $D_{2'}$. With reference to FIGS. 4 and 8, the second and fourth layers 68B and 70B may be disposed substantially on the tip portion 34 of the substrate 28, with the second layer 68B being disposed substantially on the first and third facets 38A and 38C and extending from the tip region 35 to about the first junction 39-1 and the fourth layer 70B being disposed substantially on the fourth facet 38D and extending from the tip region 35 to about the fourth junction 39-4. In other aspects (not shown), the second distance $D_{2'}$ may be less than the fourth distance $D_{4'}$, e.g., the second layer 68B may be disposed substantially on the third facet 38C and the fourth layer 70B may be disposed substantially on the second and fourth facets 38B and 38D. In some examples, as shown in FIG. 8, the second and fourth distances $D_{2'}$ and $D_{4'}$ are both different from, e.g., less than, the first and third distances $D_{1'}$, and $D_{3'}$, respectively. In other examples (not shown), the second distance $D_{2'}$ may be substantially the same as the first distance $D_{1'}$ or the fourth distance $D_{4'}$ may be substantially the same as the third distance $D_{3'}$. In further examples, the first and second coatings 68 and 70 may each comprise only a single layer, e.g., layers 68B and 70B (with the first and third layers 68A and 70A shown in dashed lines in FIG. 8 indicating that they are optional), that are disposed substantially on the respective first or second outer side 48 and 50 and may comprise substantially the same features described above.

In all examples in FIG. 8, the coatings 68 and 70 and/or layers thereof 68A, 68B, 70A, and 70B may comprise the same or different material(s), as described herein. In some aspects, the first and third layers 68A and 70A may comprise a first (same) material and the second and fourth layers 68B and 70B may comprise a second (same) material that is different from the first material. In other aspects, the first and third layers 68A and 70A may comprise a first (same) material, the second layer 68B may comprise a second material that is different from the first material, and the fourth layer 70B may comprise a third material that is different from the first and second materials. Although specific examples of the different extensions of the first and second coatings 68 and 70 are depicted in FIG. 8, it is understood that the first and second coatings 68 and 70 and/or one or more layers 68A, 68B, 70A, and 70B thereof may extend along any portion of the substrate 28, so long as the distance(s) $D_{1'}$ and $D_{2'}$ by which the first coating 68 (or at least one layer 68A and 68B thereof) extend along the first outer side 48 of the substrate 28 is different from the corresponding distance(s) $D_{3'}$ and/or $D_{4'}$ by which the second coating 70 (or at least one layer 70A and 70B thereof) extend along the second outer side 50 of the substrate 28.

Figure 9:
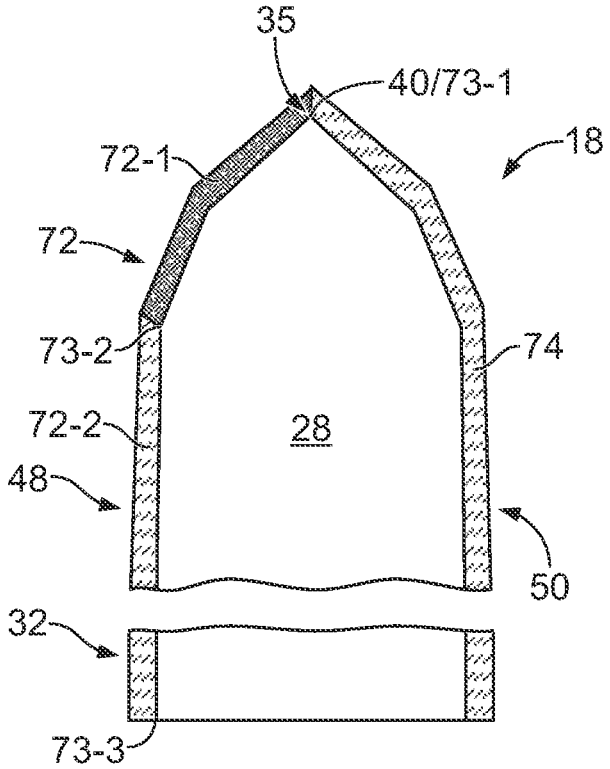
Figure 10:
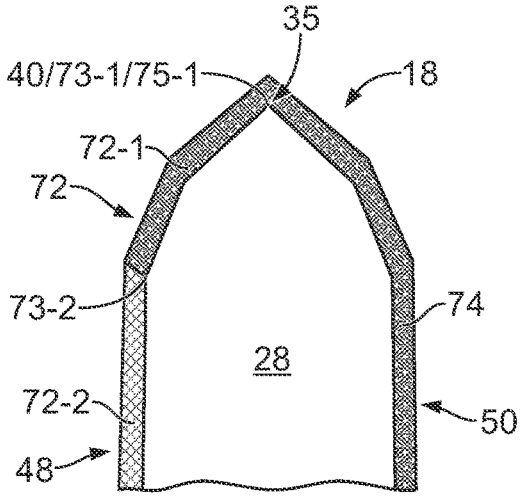

With reference to FIGS. 9-13, in further embodiments, a difference between a first and a second coating 72 and 74 may be that one or both of the first and second coatings 72 and 74 comprise two or more sections, in which each section is substantially different from an adjacent or neighboring section on the same outer side 48 and 50 of the substrate 28. As shown in FIGS. 9 and 10, one outer side, e.g., a first outer side 48, of a substrate 28 may comprise a first coating 72 with one or more sections, e.g., a first section 72-1 and a second section 72-2; and the other outer side, e.g., a second outer side 50, of the substrate 28 may comprise a second coating 74 that may be substantially continuous, i.e., a single section. The first section 72-1 of the first coating 72 may extend along the first outer side 48 substantially from a first point or location 73-1, which may substantially correspond to a tip region 35 of the substrate 28, to a second point or location 73-2 on the first outer side 48; and the second section 72-2 may extend substantially from the second location 73-2 to a third point or location 73-3 on the first outer side 48. With reference to FIGS. 4, 9, and 10, the first section 72-1 may be located substantially on one or both of the facets 38A and 38C on the first outer side 48, and the second section 72-2 may be located substantially on the blade body 30. In some examples, the second location 73-2 may be positioned at about a junction between a facet and the blade body 30, e.g., junction 39-1 between the first facet 38A and the blade body 30, as shown. In other examples, the second location 73-2 may be positioned at about a junction between two adjacent facets, e.g., junction 39-2 between the first and third facets 38A and 38C (not shown; see FIGS. 12 and 13). The third location 73-3 may be spaced apart from the second location 73-2 and may be located, for example, toward or near the base 32 of the substrate 28, as shown in FIG. 9. The second coating 74 may extend from the tip region 35 toward the base 32.

With continued reference to FIGS. 9 and 10, the first section 72-1 is substantially different from the second section 72-2. For example, the first section 72-1 may comprise one or more first materials, and the second section 72-2 may comprise one or more second materials, at least one of which is different from the one or more first materials, as described herein. In some examples, as shown in FIG. 9, the second section 72-2 and the second coating 74 may comprise the same material(s), as compared to each other, and the first section 72-1 may comprise at least one different material. In other examples, as shown in FIG. 10, the first section 72-1 and the second coating 74 may comprise the same material(s), as compared to each other, and the second section 72-2 may comprise at least one different material. In further examples (not shown), the first and second sections 72-1 and 72-2 and the second coating 74 may each comprise at least one different material, as compared to each other. Although the sections 72-1 and 72-2 and the second coating 74 are all depicted in FIGS. 9 and 10 as comprising one layer, it is understood that one or both of the sections 72-1 and 72-2 and/or the second coating 74 could also comprise two or more layers, as described herein.

Figure 11:
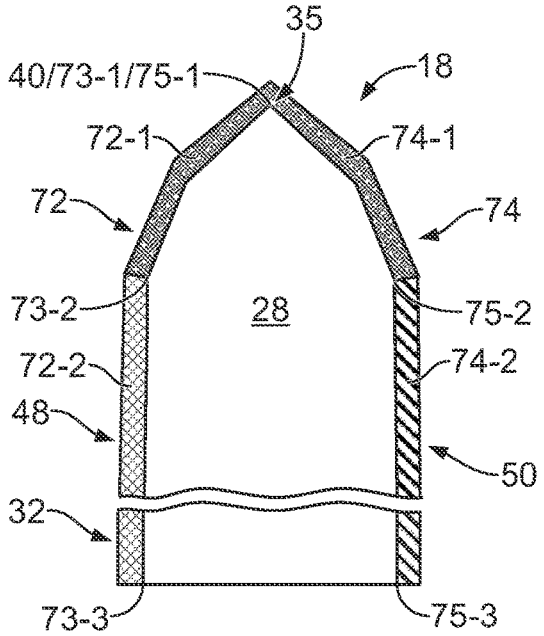
Figure 12:
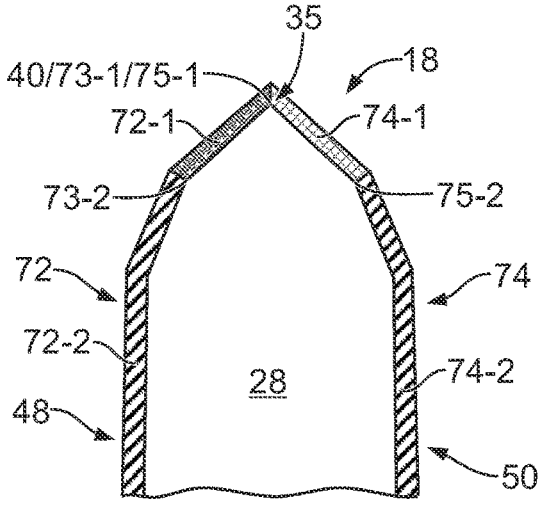
Figure 13:
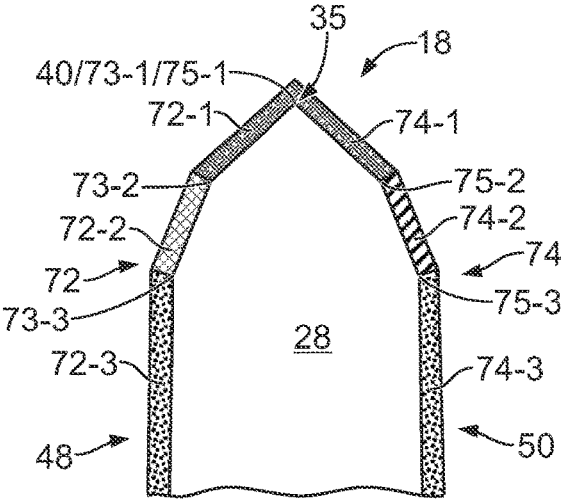

FIGS. 11-13 illustrate examples in which the first and second coatings 72 and 74 each comprise two or more sections. With reference to FIGS. 11 and 12, the first coating 72 on the first outer side 48 of the substrate 28 may comprise first and second sections 72-1 and 72-2, and the second coating 74 on the second outer side 50 of the substrate 28 may comprise third and fourth sections 74-1 and 74-2. The first section 72-1 of the first coating 72 may extend along the first outer side 48 substantially from a first point or location 73-1, which may substantially correspond to the tip region 35 of the substrate 28, to a second point or location 73-2 on the first outer side 48; and the second section 72-2 may extend substantially from the second location 73-2 to a third point or location 73-3 on the first outer side 48. The third section 74-1 of the second coating 74 may extend along the second outer side 50 substantially from a fourth point or location 75-1, which may also substantially correspond to the tip region 35 of the substrate 28, to a point or fifth location 75-2 on the second outer side 50; and the fourth section 74-2 may extend substantially from the fifth location 75-2 to a sixth point or location 75-3 on the second outer side 50.

With reference to FIGS. 4, 11, and 12, the first and third sections 72-1 and 74-1 may be located substantially on one or both sets of facets 38A, 38C and 38B, 38D on the respective first or second outer side 48 and 50. For example, in FIG. 11, the second location 73-2 may be positioned at about the junction 39-1 between the first facet 38A and the blade body 30, and the fifth location 75-2 may be positioned at about the junction 39-3 between the second facet 38B and the blade body 30, with the second and fourth sections 72-2 and 74-2 being located substantially on the blade body 30. In FIG. 12, the second location 73-2 may be positioned at about the junction 39-2 between the first and third facets 38A and 38C, and the fifth location 75-2 may be positioned at about the junction 39-4 between the second and fourth facets 38B and 38D, with the second and fourth sections 72-2 and 74-2 being located substantially on the first and second facets 38A and 38B, respectively, and on the blade body 30. In FIGS. 11 and 12, the third and sixth locations 73-3 and 75-3 (not shown in FIG. 12) may be spaced apart from the second and fifth locations 73-2 and 75-2, respectively, and may be located, for example, toward or near the base 32 of the substrate 28.

The first section 72-1 of the first coating 72 in FIGS. 11 and 12 is substantially different from the second section 72-2, and the third section 74-1 of the second coating 74 is substantially different from the fourth section 74-2. For example, the first section 72-1 may comprise one or more first materials, and the second section 72-2 may comprise one or more second materials, at least one of which is different from the one or more first materials, as described herein. The third section 74-1 may similarly comprise one or more third materials, and the fourth section 74-2 may comprise one or more fourth materials, at least one of which is different from the one or more third materials. In some examples, the first and third sections 72-1 and 74-1 may comprise the same material(s), as compared to each other, and the second and fourth sections 72-2 and 74-2 may comprise at least one different material, as compared to each other. In other examples, the first and third sections 72-1 and 74-1 may comprise at least one different material, as compared to each other, and the second and fourth sections 72-2 and 74-2 may comprise the same or different material(s), as compared to each other. Although the sections 72-1, 72-2, 74-1, and 74-2 are all depicted in FIGS. 11 and 12 as comprising one layer, it is understood that one or more of the sections 72-1, 72-2, 74-1, and 74-2 could also comprise two or more layers, as described herein.

With reference to FIG. 13, the first coating 74 on the first outer side 48 of the substrate 28 may comprise first, second, and third sections 72-1, 72-2, and 72-3, and the second coating 74 on the second outer side 50 of the substrate 28 may comprise fourth, fifth, and sixth sections 74-1, 74-2, and 74-3. The first section 72-1 of the first coating 72 may extend along the first outer side 48 substantially from a first point or location 73-1, which may substantially correspond to a tip region 35 of the substrate 28, to a second point or location 73-2 on the first outer side 48; the second section 72-2 may extend substantially from the second location 73-2 to a third point or location 73-3 on the first outer side 48; and the third section 72-3 may extend substantially from the third location 73-3 to a fourth point or location (not shown) on the first outer side 48. The fourth section 74-1 of the second coating 74 may extend along the second outer side 50 substantially from a fifth point or location 75-1, which may also substantially correspond to the tip region 35 of the substrate 28, to a sixth point or location 75-2 on the second outer side 50; the fifth section 74-2 may extend substantially from the sixth location 75-2 to a seventh point or location 75-3 on the second outer side 50; and the sixth section 74-3 may extend substantially from the seventh location 75-3 to an eighth point or location (not shown) on the second outer side 50.

The first, second, fourth, and fifth sections 72-1, 72-2, 74-1, and 74-2 in FIG. 13 may be located substantially on the facets 38A-38D, and the third and sixth sections 72-3 and 74-3 may be located substantially on the blade body 30 (see FIG. 4). For example, the second location 73-2 may be positioned at about the junction 39-2 between the first and third facets 38A and 38C; the third location 73-3 may be positioned at about the junction 39-1 between the first facet 38A and the blade body 30; the sixth location 75-2 may be positioned at about the junction 39-4 between the second and fourth facets 38B and 38D; and the seventh location 75-3 may be positioned at about the junction 39-3 between the second facet 38A and the blade body 30. The fourth and eighth locations (not shown; see locations 73-3 and 75-3 in FIG. 11) may be spaced apart from the third and seventh locations 73-3 and 75-3, respectively, and may be located, for example, toward or near the base 32 of the substrate 28.

With continued reference to FIG. 13, the first section 72-1 of the first coating 72 is substantially different from the second section 72-2, and the third section 72-3 is substantially different from the second section 72-2. The fourth section 74-1 of the second coating 74 is substantially different from the fifth section 74-2, and the sixth section 74-3 is substantially different from the fifth section 74-2. As described herein, the sections 72-1 to 72-3 and 74-1 to 74-3 may comprise at least one different material, as compared to an adjacent or neighboring section on the same outer side 48 and 50. In some examples, the first and fourth sections 72-1 and 74-1 may comprise the same material(s), as compared to each other; and at least one of the second and fifth sections 72-2 and 74-2 (as compared to each other) or the third and sixth sections 72-3 and 74-3 (as compared to each other) may comprise at least one different material. In other examples, the first and fourth sections 72-1 and 74-1 may comprise at least one different material, as compared to each other, and the second, third, fifth, and sixth sections 72-2, 72-3, 74-2, and 74-3 may comprise the same or different materials, as compared to each other. Although the sections 72-1 to 72-3 and 74-1 to 74-3 are all depicted in FIG. 13 as comprising one layer, it is understood that one or more of the sections 72-1 to 72-3 and 74-1 to 74-3 could also comprise two or more layers, as described herein.

Figure 14:
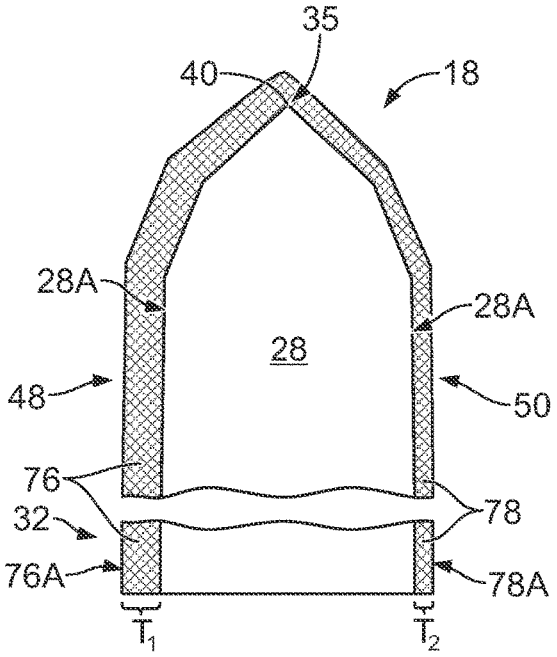
Figure 15:
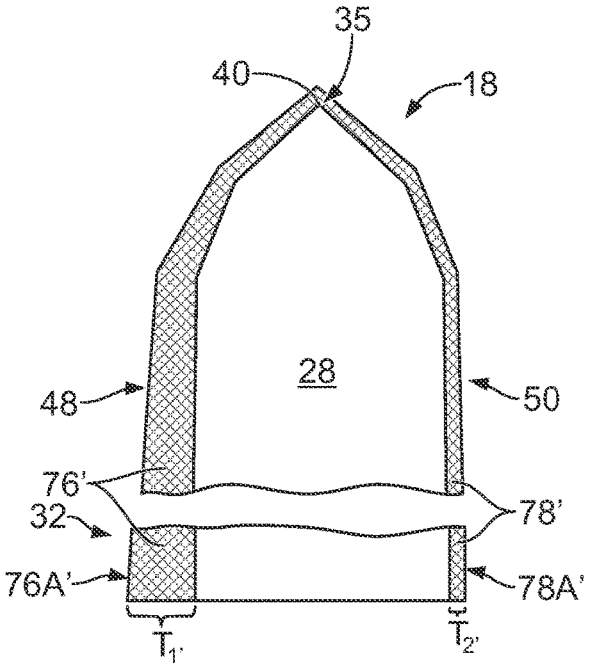

With reference to FIGS. 14 and 15, in further embodiments, a difference between a first and a second coating 76, 76' and 78, 78' may be a thickness of the coatings 76, 76' and 78, 78'. The first coating 76, 76' may comprise a first thickness $T_1$, $T_{1'}$ and the second coating 78, 78' may comprise a second thickness $T_2$, $T_{2'}$ in which the thicknesses $T_1$, $T_{1'}$, $T_2$, and $T_{2'}$ are measured between an outer surface 76A, 76A' and 78A, 78A' of the respective coating 76, 76' and 78, 78' and an outer surface 28A of the substrate 28. The second thickness $T_2$, $T_{2'}$ is different from the first thickness $T_1$, $T_{1'}$. As shown in FIG. 14, the first and second thicknesses $T_1$ and $T_2$ are substantially constant in a direction extending from the tip 40 toward the base 32 of the substrate 28, with the first thickness $T_1$ being greater than the second thickness $T_2$. In FIG. 15, the second thickness $T_{2'}$ is substantially constant in the direction extending from the tip 40 toward the base 32 of the substrate 28, and the first thickness $T_{1'}$ varies along at least a section of the first coating 76' in the direction extending from the tip 40 toward the base 32, with the first thickness $T_{1'}$ being different from the second thickness $T_{2'}$ along at least a section of the first coating 76'. In some aspects, the first thickness $T_{1'}$ may increase along at least a section of the first coating 76' extending in a direction from the tip 40 to the base 32, i.e., the first thickness $T_{1'}$ of first coating 76' tapers in a direction extending from the base 32 toward the tip 40. The first and second coatings 76, 76' and 78, 78' in FIGS. 14 and 15 may comprise a same or different material, as described herein. Although the coatings 76, 76' and 78, 78' are depicted in FIGS. 14 and 15 as comprising one layer, it is understood that one or both of the coatings 76, 76' and 78, 78' could also comprise two or more layers. In the examples shown in FIGS. 14 and 15, an outer shape of the coatings 76, 76' and 78, 78' may generally conform to and/or mirror an outer shape of the underlying portions of the substrate 28 on which the coatings 76, 76' and 78, 78' are formed.

Figure 17:
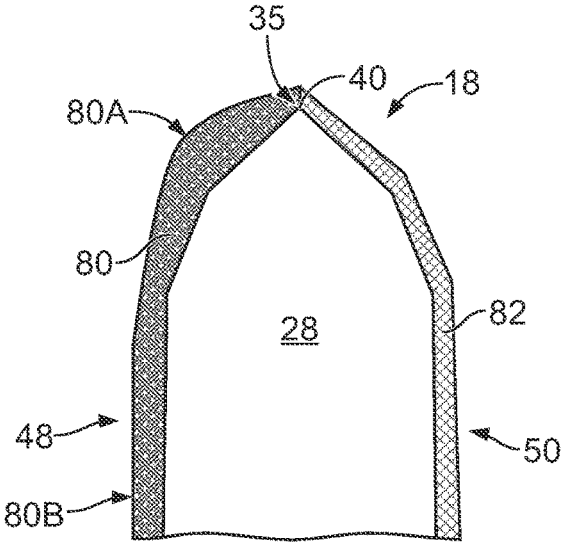

With reference to FIG. 17, in further embodiments, a difference between a first and a second coating 80 and 82 may be an outer shape. The first and the second coatings 80 and 82 may extend from a tip region 35 toward the base (not shown) along a respective first or second outer side 48 or 50 of a substrate 28. An outer shape of the first coating 80 may comprise a first outer shape, and an outer shape of the second coating 82 may comprise a second outer shape that is different from the first outer shape. As shown in FIG. 17, the second coating 82 may substantially conform to and/or mirror a shape of one or more underlying portions of the substrate 28 on which the second coating 82 is formed, such that the outer shape of the second coating 82 is substantially similar to an outer shape of the underlying portion(s) of the substrate 28. For example, with reference to FIGS. 4 and 17, the outer shape of the second coating 82 may substantially conform to the outer shape of the second and fourth facet outer surfaces 39B and 39D and the second blade body outer surface 31B. The first coating 80 may comprise at least one section that does not conform to a shape of one or more underlying portions of the substrate 28 on which the first coating 80 is formed. For example, with reference to FIGS. 4 and 17, the first coating 80 may comprise a thickened section 80A where the first coating 80 bulges outward from the substrate 28 and forms an outer shape that is different from an outer shape of one or more of the underlying portions of the substrate 28, e.g., the first and third facet outer surfaces 39A and 39C. Because the substrate 28 is substantially symmetrical, the outer shape of the first coating 80 may also be different from the outer shape of a corresponding portion of the second coating 82, e.g., the portion of the second coating 82 that is positioned over the second and fourth facet outer surfaces 39B and 39D. As shown in FIG. 17, the first coating 80 may optionally comprise a second section 80B with an outer shape that conforms more closely to the outer shape of the underlying portion(s), e.g., the first blade body outer surface 31A, of the substrate 28.

Figure 20:
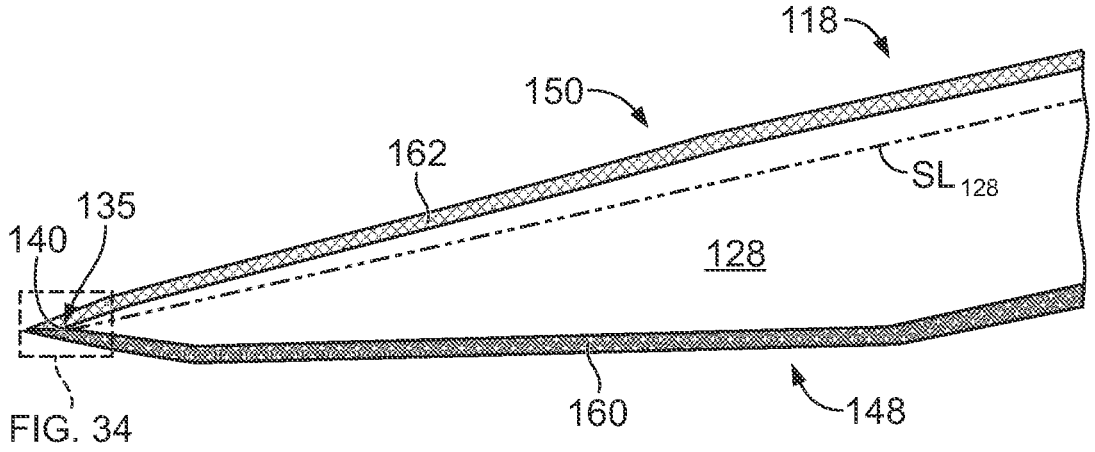
FIGS. 20, 21, 22, 23, 24, 25, 26, 27, 28, 29, 30, 31, 32 and 33 are side views of a tip portion of the razor blade of FIG. 18 comprising one or more coatings in accordance with the present disclosure.
Figure 21:
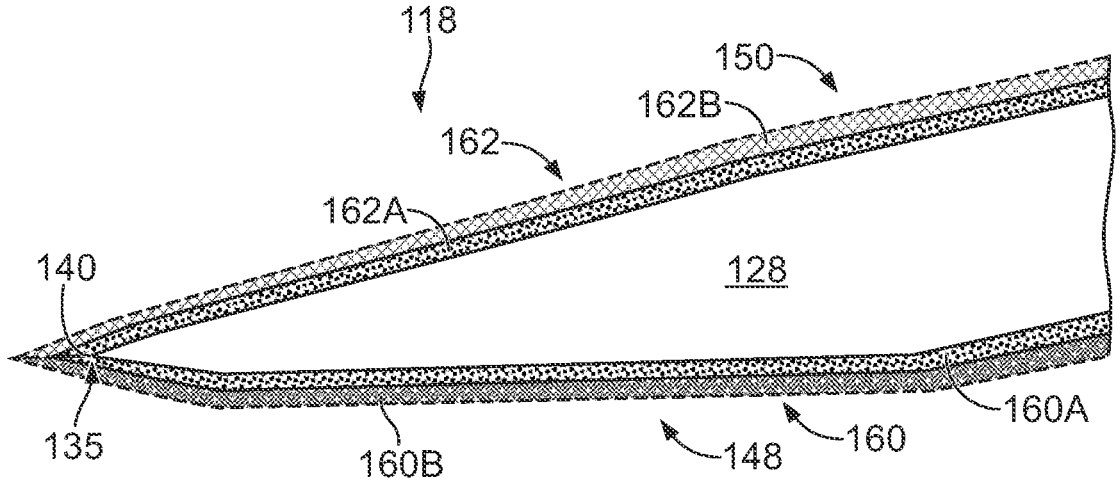
Figure 22:
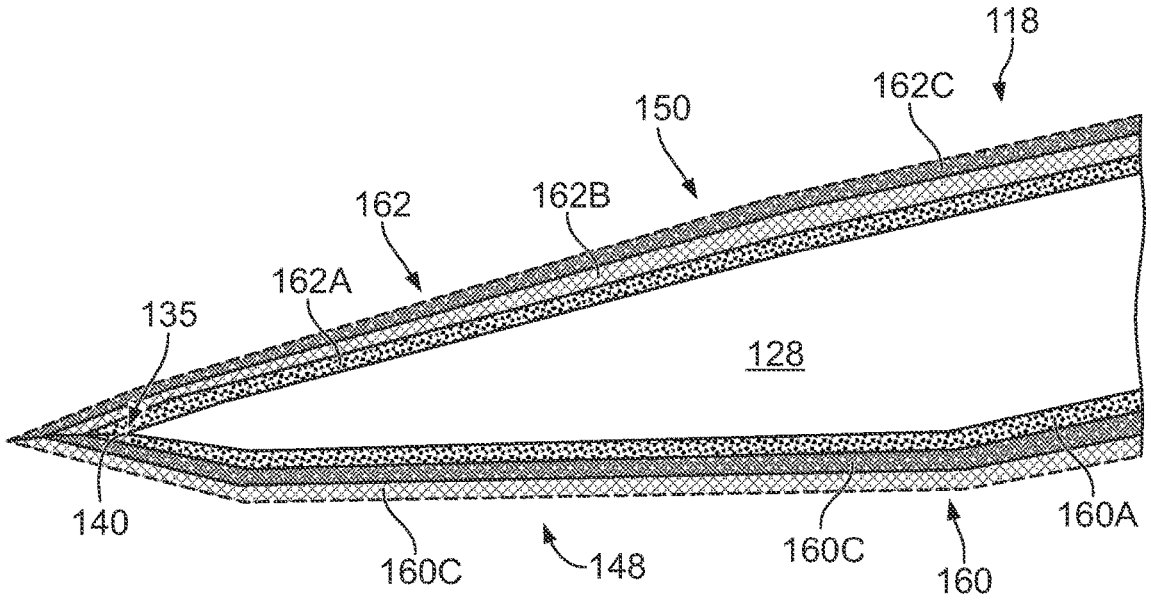

With reference now to FIGS. 20-33, the razor blade 118 may comprise one or more coatings that are substantially similar to the razor blade 18 depicted in FIGS. 4-17 and described herein in detail. As shown in FIGS. 20-22, the razor blade 118 may comprise a first coating 160 disposed substantially on the first outer side 148 of the substrate 128 and a second coating 162 disposed substantially on the second outer side 150. The first and second coatings 160 and 162 extend from the tip region 135 toward the base (not shown; see base 132 in FIG. 18) along the respective first and second outer sides 148 and 150 of the substrate 128. In some examples, the first and second coatings 160 and 162 may each comprise a single layer of material, as shown in FIG. 20. In other examples, at least one of the first or the second coating 160 and 162 may comprise a plurality of layers of material(s), as shown in FIGS. 21 and 22 and described in detail herein.

As shown in FIGS. 21 and 22, one or both of the first and second coatings 160 and 162 may comprise a plurality of layers of material(s), and a difference between the first and second coatings 160 and 162 may be a number of layers of material(s) on each outer side 148 and 150 of the substrate 128. In some aspects, the first coating 160 may comprise a first number of layers, and the second coating 162 may comprise a second number of layers that is different from the first number of layers. With reference to FIG. 21, the first coating 160 may comprise at least one of first or second layers 160A and 160B, and the second coating 162 may comprise at least one of third or fourth layers 162A and 162B, in which the second layer 160B is formed on top of at least a portion of the first layer 160A and the fourth layer 162B is formed on top of at least a portion of the third layer 162A. With reference to FIG. 22, the first coating 160 may comprise at least one of first, second, or third layers 160A-160C, and the second coating 162 may comprise at least one of fourth, fifth, and sixth layers 162A-162C, in which the second layer 160B is formed on top of at least a portion of the first layer 160A, the third layer 160C is formed on top of at least a portion of the second layer 160B, the fifth layer 162B is formed on top of at least a portion of the fourth layer 162A, and the sixth layer 162C is formed on top of at least a portion of the fifth layer 162B. As described herein in detail with respect to FIGS. 5 and 6, in some examples, the first outer side 148 of the substrate 128 in FIGS. 21 and 22 may comprise the first coating 160 with two or three layers 160A-160C and the second outer side 150 may comprise the second coating 162 with fewer layers (illustrated with dashed lines on the top side in FIGS. 21 and 22). In other examples, the second outer side 150 of the substrate 128 may comprise two or three layers 162A-162C, and the first outer side 148 may comprise the first coating 160 with fewer layers (illustrated with dashed lines on the bottom side of FIGS. 21 and 22).

In other embodiments, with reference to FIGS. 20-22, a difference between the first and second coatings 160 and 162 may be the material(s) comprising each coating 160 and 162 and/or one or more layers 160A-160C and/or 162A-162C thereof, as described herein in detail with respect to the first and second coatings 60 and 62 in FIGS. 4-6. For example, the first coating 160 may comprise one or more first materials, and the second coating 162 may comprise one or more second materials, in which at least one second material is different from at least one first material. The difference in materials may be used alone or in combination with a difference in the number of layers 160A-160C and 162A-162C formed on the first and second outer sides 148 and 150 of the substrate 128. For example, the first coating 160 may comprise a same number of layers as the second coating 162 (e.g., coatings 160 and 162 with one layer in FIG. 20; two layers 160A, 160B and 162A, 162B in FIG. 21; and three layers 160A-160C and 162A-162C in FIG. 22) or a different number of layers, as described herein, with at least one second material being different from at least one first material. The coatings 160 and 162 may comprise any of the materials with any of the properties and characteristics described herein (e.g., coefficient of friction, morphology, texture, hardness, etc.). In addition, at least a section of one or both of the coatings 160 and 162 may be subjected to one or more post-application treatments, as described herein in detail.

Figure 23:
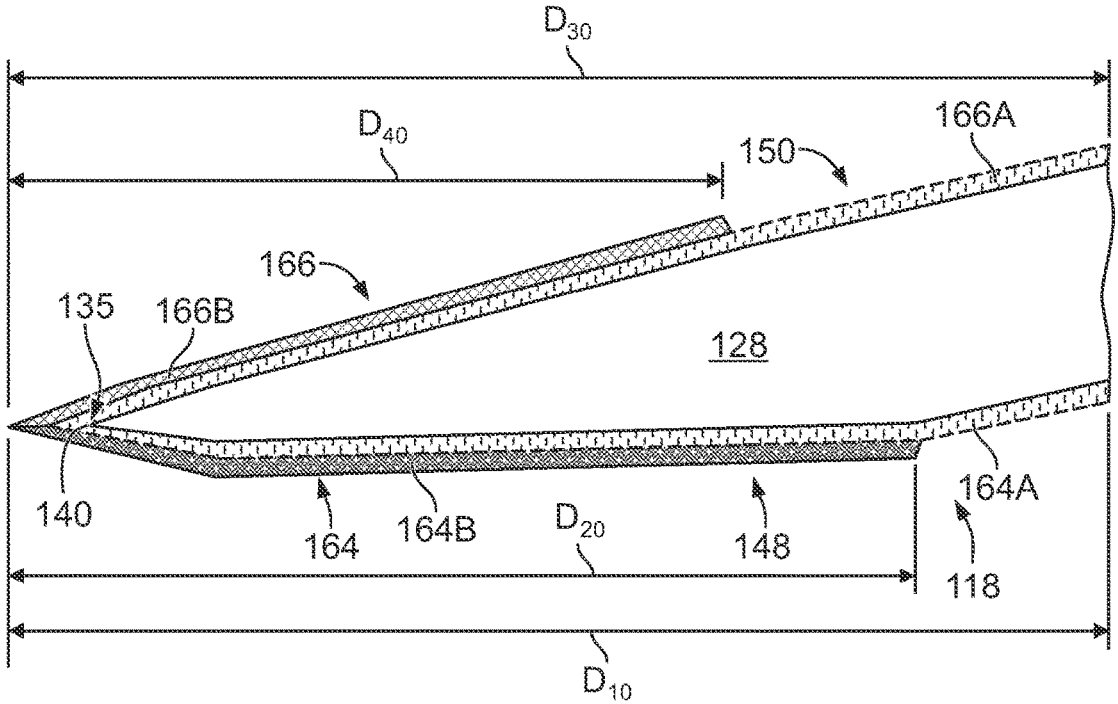
Figure 24:
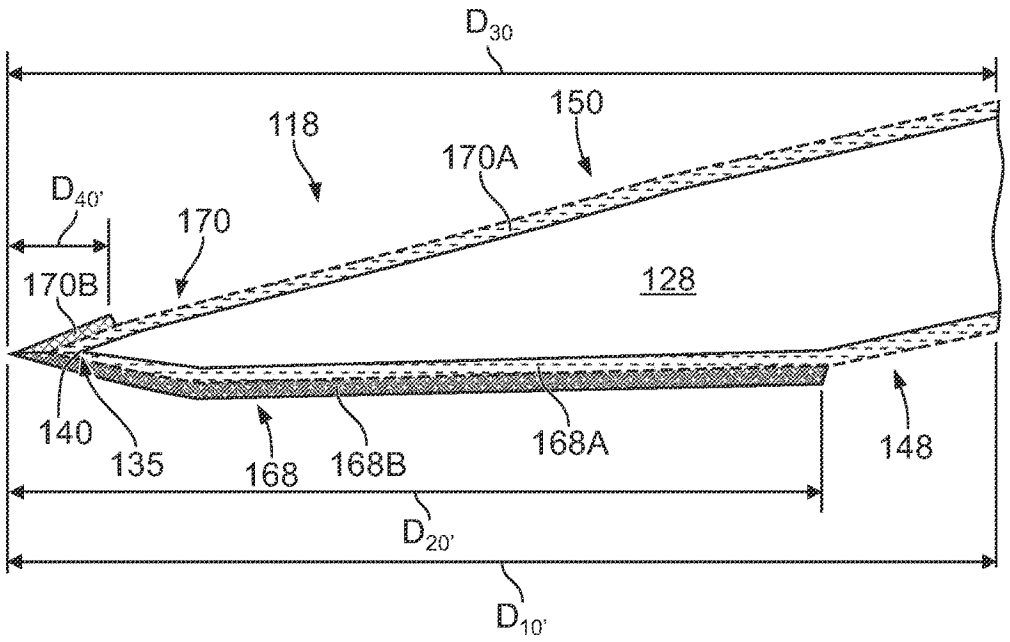

In the examples shown in FIGS. 20-22, the coating(s) 160 and 162 and layer(s) 160A-160C and 162A-162C thereof are depicted as extending along the respective first or second outer side 148 and 150 of the substrate 128 from the tip region 135 onto the blade body (not shown; see blade body 130 in FIG. 18), and in some instances, all the way to the base 132 of the razor blade 118 (see FIG. 18). In other examples as described herein, one or more of the coatings 160 and 162 and/or one or more layers 160A-160C and 162A-162C thereof may stop short of the blade body 130 and/or the base 132 (see FIGS. 23 and 24). With reference to FIGS. 18, 23, and 24, the substrate 128 may comprise first and second coatings 164, 168 and 166, 170 and/or one or more layers thereof that are disposed substantially only on the tip portion 134 of the substrate 128, e.g., on one or more of the facets 138A-138D. For instance, the first coating 164, 168 may comprise one or more layers including a first layer 164A, 168A that is disposed substantially on, and extends along a portion of, the first outer side 148 of the substrate 128 from the tip region 135 toward the base 132 for a first distance $D_{10}$, $D_{10'}$; and a second layer 164B, 168B that is formed on top of at least a portion of the first layer 164A, 168A and extends from the tip region 135 toward the base 132 for a second distance $D_{20}$, $D_{20'}$. The second coating 166, 170 may comprise one or more layers including at least a third layer 166A, 170A that is disposed substantially on, and extends along a portion of, the second outer side 150 of the substrate 128 from the tip region 135 toward the base 132 for a third distance $D_{30}$, $D_{30'}$; and a fourth layer 166B, 170B that is formed on top of at least a portion of the third layer 166A, 170A and extends from the tip region 135 toward the base 132 for a fourth distance $D_{40}$, $D_{40'}$.

The first and third layers 164A, 168A and 166A, 170A may each extend along the respective first or second outer side 148 and 150 from the tip region 135 onto the blade body 130 and toward the base 132; and the second and fourth layers 164B, 168B and 166B, 170B may be disposed substantially only on the facets 138A-138D. In the example shown in FIG. 23, the second layer 164B may extend from the tip region 135 to about the first junction 139-1 between the first facet 138A and the blade body 130, and the fourth layer 166B may extend from the tip region 135 to about the third junction 139-3 between the second facet 138B and the blade body 130. In the example shown in FIG. 24, the second layer 168B may extend from the tip region 135 to about the first junction 139-1 between the first facet 138A and the blade body 130, and the fourth layer 170B may extend from the tip region 135 to about the fourth junction 139-4 between the second and fourth facets 138B and 138D. In other examples (not shown), the second layer 164B, 168B in FIGS. 23 and 24 may be disposed substantially only on the third facet 138C and may extend from the tip region 135 to about the second junction 139-2 between the first and third facets 138A and 138C.

Because the substrate 128 in FIGS. 23 and 24 is asymmetrical, the distance by which the second layer 164B, 168B extends along the first outer side 148 of the substrate 128 may be different from the distance by which the respective fourth layer 166B, 170B extends along the second outer side 150 of the substrate 128. For example, with reference to FIGS. 18 and 23, the length of the first and third facets 138A and 138C may be greater than the length of the second and fourth facets 138B and 138D, such that the second distance $D_{20}$ is greater than the fourth distance $D_{40}$. Likewise, with reference to FIG. 24 in which the second layer 168B is disposed on both facets 138A and 138C and the fourth layer 170B is disposed on only one facet 138D, the second distance $D_{20'}$ is greater than the fourth distance $D_{40'}$. In other examples (not shown) in which the second layer 164B, 168B is disposed substantially only on the third facet 138C, the second distance $D_{20}$ is less than the fourth distance $D_{40}$ in FIG. 23 and the second distance $D_{20'}$ may still be greater than the fourth distance $D_{40'}$ in FIG. 24.

Although FIGS. 23 and 24 are depicted with two layers on each outer side, in some examples, the first and second coatings 164, 168 and 166, 170 may each comprise only a single layer, e.g., only the second and fourth layers 164B, 168B and 166B, 170B (illustrated with dashed lines in FIGS. 23 and 24), that are disposed substantially on the respective first or second outer side 148 and 150 of the substrate 128 and may comprise substantially the same features as described above. With reference to FIG. 23, the second and fourth layers 164B and 166B may comprise a different material or a same material, as compared to each other, and the first and third layers 164A and 166A (when present) may comprise a same or different material, as compared to each other. In some aspects, the material(s) comprising the first and third layers 164A and 166A may be the same as the material(s) comprising one or both of the second and fourth layers 164B and 166B, and in other aspects, the material(s)

comprising the first and third layers 164A and 166A may be different from the material(s) comprising one or both of the second and fourth layers 164B and 166B. The layers 168A, 168B, 170A, and 170B in FIG. 24 may similarly comprise the same or different material(s).

Figure 25:
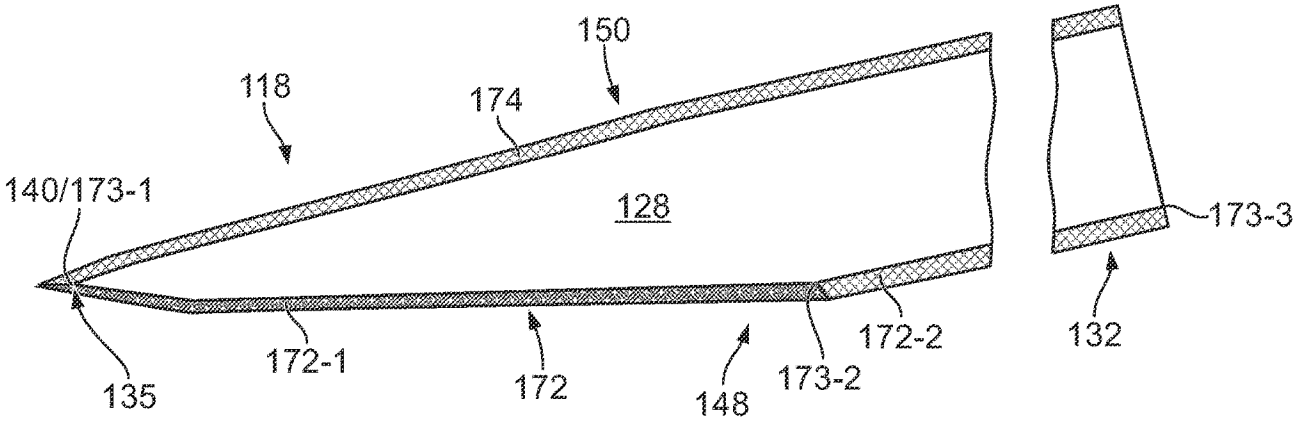
Figure 26:
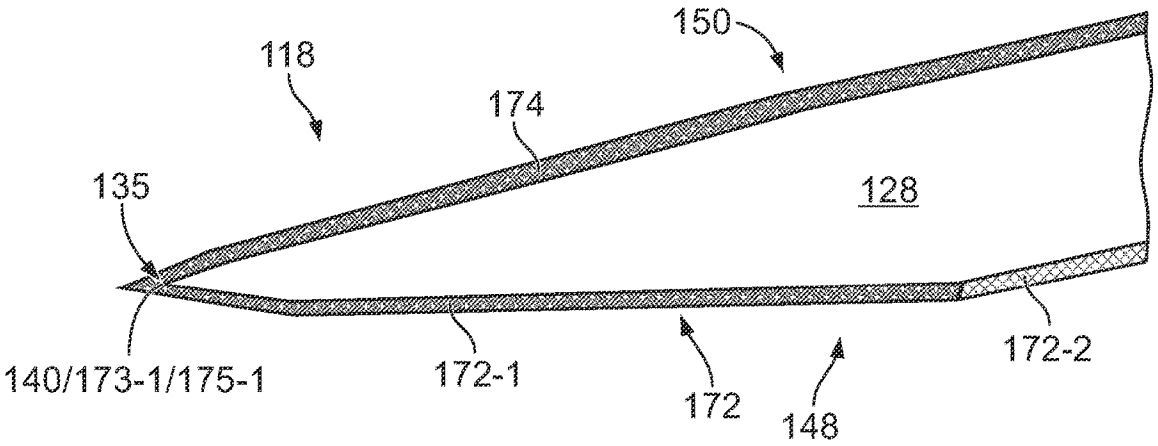

With reference to FIGS. 25-29, in further embodiments, a difference between a first and a second coating 172 and 174 may be that one or both of the first and second coatings 172 and 174 comprise two or more sections, in which each section is substantially different from an adjacent or neighboring section on the same outer side 148 and 150 of the substrate 128. As shown in FIGS. 25 and 26, one outer side, e.g., a first outer side 148, of a substrate 128 may comprise a first coating 172 with one or more sections, e.g., a first section 172-1 and a second section 172-2; and the other outer side, e.g., a second outer side 150, of the substrate 128 may comprise a second coating 174 that may be substantially continuous, i.e., a single section. The first section 172-1 of the first coating 172 may extend along the first outer side 148 substantially from a first point or location 173-1, which may substantially correspond to a tip region 135 of the substrate 128, to a second point or location 173-2 on the first outer side 148; and the second section 172-2 may extend substantially from the second location 173-2 to a third point or location 173-3 on the first outer side 148.

With reference to FIGS. 18, 25, and 26, the first section 172-1 may be located substantially on one or both of the facets 138A and 138C on the first outer side 148, and the second section 172-2 may be located substantially on the blade body 130. In some examples, the second location 173-2 may be positioned at about a junction between a facet and the blade body 130, e.g., junction 139-1 between the first facet 138A and the blade body 130, as shown. In other examples, the second location 173-2 may be positioned at about a junction between two adjacent facets, e.g., junction 139-2 between the first and third facets 138A and 138C (not shown; see FIGS. 28 and 29). The third location 173-3 may be spaced apart from the second location 173-2 and may be located, for example, toward or near the base 132 of the substrate 128, as shown in FIG. 25. The second coating 174 may extend from the tip region 135 toward the base 132. As described herein in detail with respect to FIGS. 9 and 10, the first section 172-1 of the first coating 172 in FIGS. 25 and 26 is substantially different from the second section 172-2. Although the sections 172-1 and 172-2 and the second coating 174 are all depicted in FIGS. 25 and 26 as comprising one layer, it is understood that one or both of the sections 172-1 and 172-2 and/or the second coating 174 could also comprise two or more layers.

Figure 27:
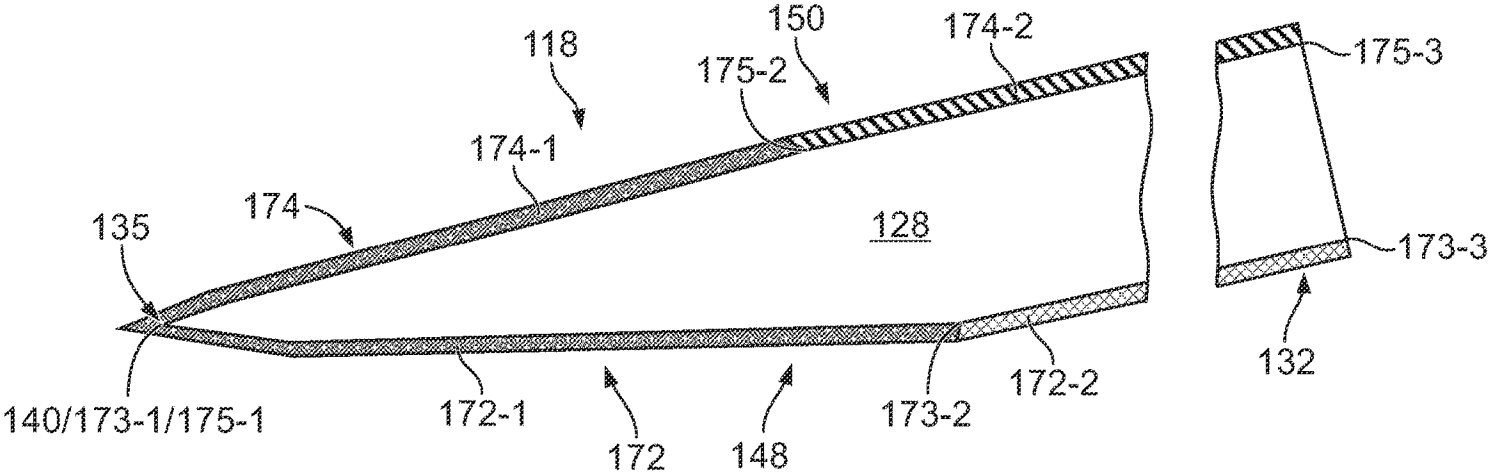
Figure 28:
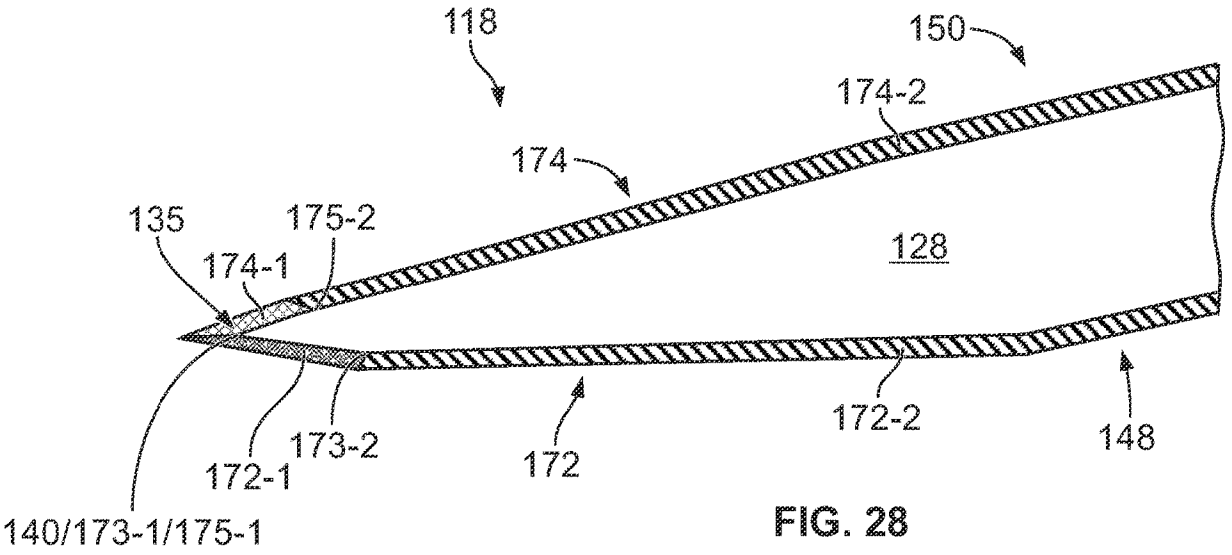
Figure 29:
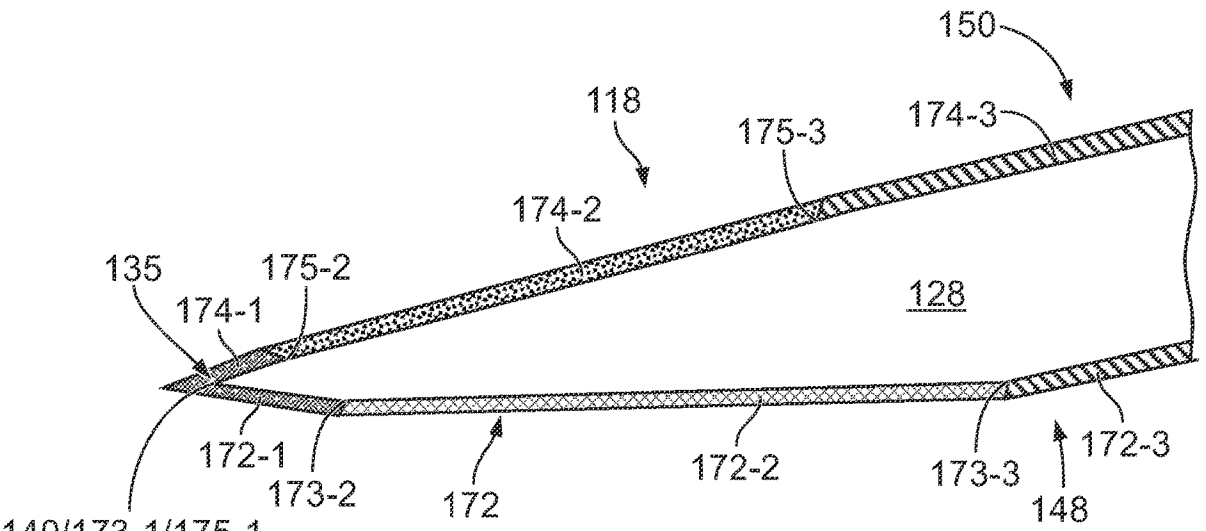

FIGS. 27-29 illustrate examples in which the first and second coatings 172 and 174 each comprise two or more sections. With reference to FIGS. 27 and 28, the first outer side 148 of the substrate 128 may comprise a first coating 172 with first and second sections 172-1 and 172-2, and a second outer side 150 of the substrate 128 may comprise a second coating 174 with third and fourth sections 174-1 and 174-2. The first section 172-1 of the first coating 172 may extend along the first outer side 148 substantially from a first point or location 173-1, which may substantially correspond to a tip region 135 of the substrate 128, to a second point or location 173-2 on the first outer side 148; and the second section 172-2 may extend substantially from the second location 173-2 to a third point or location 173-3 on the first outer side 148. The third section 174-1 of the second coating 174 may extend along the second outer side 150 substantially from a fourth point or location 175-1, which may also substantially correspond to the tip region 135 of the substrate 128, to a fifth point or location 175-2 on the second outer side 150; and the fourth section 174-2 may extend substantially from the fifth location 175-2 to a sixth point or location 175-3 on the second outer side 150.

With reference to FIGS. 18, 27, and 28, the first and third sections 172-1 and 174-1 may be located substantially on one or both sets of facets 138A, 138C and 138B, 138D on the respective first or second outer side 148 and 150 of the substrate 128. For example, in FIG. 27, the second location 173-2 may be positioned at about the junction 139-1 between the first facet 138A and the blade body 130, and the fifth location 175-2 may be positioned at about the junction 139-3 between the second facet 138B and the blade body 130, with the second and fourth sections 172-2 and 174-2 being located substantially on the blade body 130. In FIG. 28, the second location 173-2 may be positioned at about the junction 139-2 between the first and third facets 138A and 138C, and the fifth location 175-2 may be positioned at about the junction 139-4 between the second and fourth facets 138B and 138D, with the second and fourth sections 172-2 and 174-2 being located substantially on the first and second facets 138A and 138B, respectively, and on the blade body 130. The third and sixth locations 173-3 and 175-3 may be spaced apart from the second and fifth locations 173-2 and 175-2, respectively, and may be located, for example, toward or near the base 132 of the substrate 128, as shown in FIG. 27.

With reference to FIG. 29, the first outer side 148 of a substrate 128 may comprise a first coating 172 with first, second, and third sections 172-1, 172-2, and 172-3, and the second outer side 150 of the substrate 128 may comprise a second coating 174 with fourth, fifth, and sixth sections 174-1, 174-2, and 174-3. The first section 172-1 of the first coating 172 may extend along the first outer side 148 substantially from a first point or location 173-1, which may substantially correspond to the tip region 135 of the substrate 128, to a second point or location 173-2 on the first outer side 148; the second section 172-2 may extend substantially from the second location 173-2 to a third point or location 173-3 on the first outer side 148; and the third section 172-3 may extend substantially from the third location 173-3 to a fourth point or location (not shown) on the first outer side 148. The fourth section 174-1 of the second coating 174 may extend along the second outer side 150 substantially from a fifth point or location 175-1, which may also substantially correspond to the tip region 135 of the substrate 128, to a sixth point or location 175-2 on the second outer side 150; the fifth section 174-2 may extend substantially from the sixth location 175-2 to a seventh point or location 175-3 on the second outer side 150; and the sixth section 174-3 may extend substantially from the seventh location 175-3 to an eighth point or location (not shown) on the second outer side 150.

The first, second, fourth, and fifth sections 172-1, 172-2, 174-1, and 174-2 in FIG. 29 may be located substantially on the facets 138A-138D, and the third and sixth sections 172-3 and 174-3 may be located substantially on the blade body 130 (see FIG. 18). For example, the second location 173-2 may be positioned at about the junction 139-2 between the first and third facets 138A and 138C; the third location 173-3 may be positioned at about the junction 139-1 between the first facet 138A and the blade body 130; the sixth location 175-2 may be positioned at about the junction 139-4 between the second and fourth facets 138B and 138D; and the seventh location 175-3 may be positioned at about the junction 139-3 between the second facet 138B and the blade body 130. The fourth and eighth locations (not shown) may be spaced apart from the third and seventh locations 173-3 and 175-3, respectively, and may be located, for example, toward or near the base 132 of the substrate 128 (see locations 173-3 and 175-3 in FIG. 27).

As described herein in detail with respect to FIGS. 11-13, the first section 172-1 of the first coating 172 in FIGS. 27-29 is substantially different from the second section 172-2; the third section 172-3 is substantially different from the second section 172-2; the fourth section 174-1 of the second coating 174 is substantially different from the fifth section 174-2; and the sixth section 174-3 is substantially different from the fifth section 174-2. Although the sections 172-1 to 172-3 and 174-1 to 174-3 are all depicted in FIGS. 27-29 as comprising one layer, it is understood that one or more of the sections 172-1 to 172-3 and 174-1 to 174-3 could also comprise two or more layers.

Figure 30:
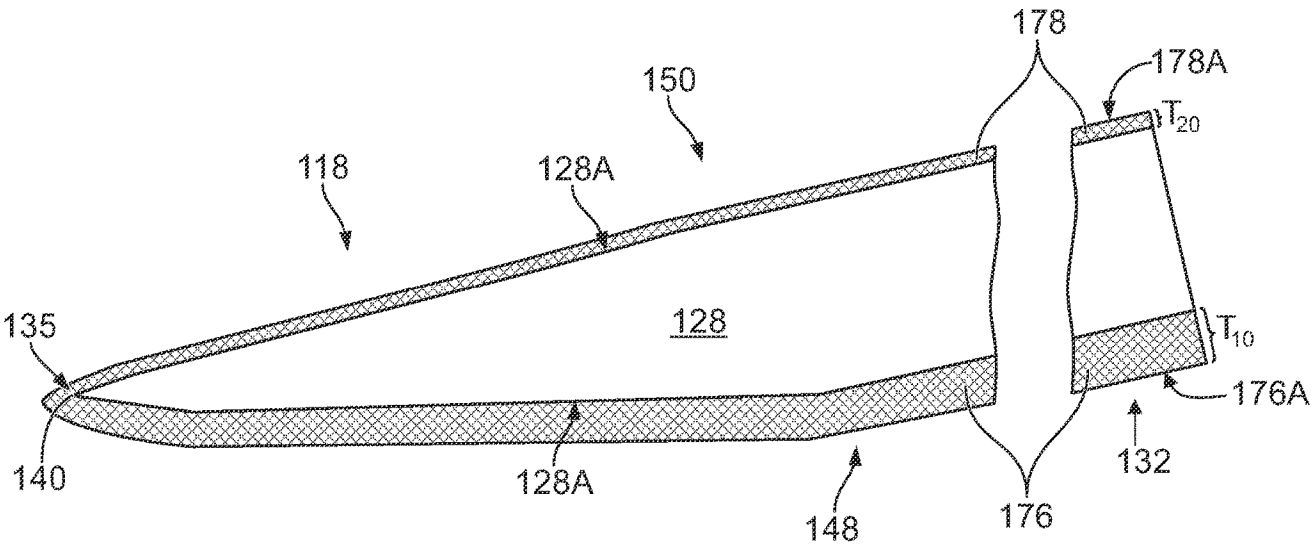
Figure 31:
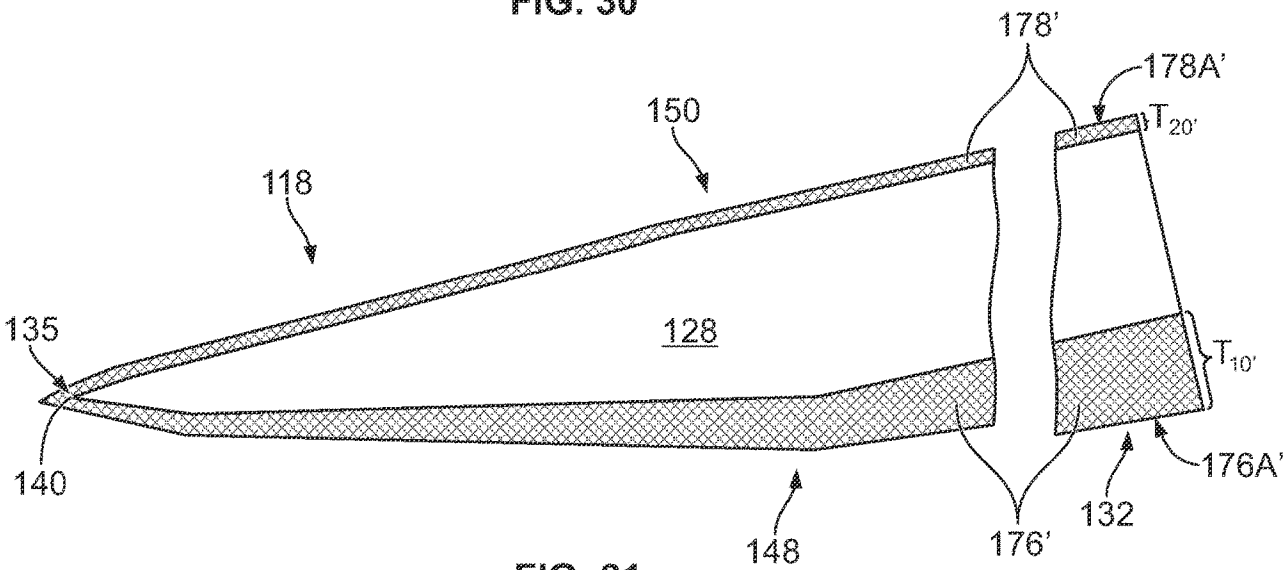

With reference to FIGS. 30 and 31, in further embodiments, a difference between a first and a second coating 176, 176' and 178, 178' may be a thickness of the coatings 176, 176' and 178, 178'. The first coating 176, 176' may comprise a first thickness $T_{10}$, $T_{10'}$ and the second coating 178, 178' may comprise a second thickness $T_{20}$, $T_{20'}$ in which the thicknesses $T_{10}$, $T_{10'}$, $T_{20}$, and $T_{20'}$ are measured between an outer surface 176A, 176A' and 178A, 178A' of the respective coating 176, 176' and 178, 178' and an outer surface 128A of the substrate 128. The second thickness $T_{20}$, $T_{20'}$ is different from the first thickness $T_{10}$, $T_{10'}$. As shown in FIG. 30, the first and second thicknesses $T_{10}$ and $T_{20}$ are substantially constant in a direction extending from the tip 140 toward the base 132 of the substrate 128, with the first thickness $T_{10}$ being greater than the second thickness $T_{20}$. In FIG. 31, the second thickness $T_{20'}$ is substantially constant in a direction extending from the tip 140 toward the base 132 of the substrate 128, and the first thickness $T_{10'}$ varies along at least a section of the first coating 176' in the direction extending from the tip 140 toward the base 132, with the first thickness $T_{10'}$ being different from the second thickness $T_{20'}$ along at least a section of the first coating 176'. In some aspects, the first thickness $T_{10'}$ may increase along at least a section of the first coating 176' in a direction extending from the tip 140 to the base 132, i.e., the first thickness $T_{10'}$ of the first coating 176' tapers in a direction extending from the base 132 toward the tip 140. The first and second coatings 176, 176' and 178, 178' in FIGS. 30 and 31 may comprise a same or different material, as described herein. Although the coatings 176, 176' and 178, 178' are depicted in FIGS. 30 and 31 as comprising one layer, it is understood that one or both of the coatings 176, 176' and 178, 178' could also comprise two or more layers. In the examples shown in FIGS. 30 and 31, an outer shape of the coatings 176, 176' and 178, 178' may generally conform to and/or mirror an outer shape of the underlying portions of the substrate 128 on which the coatings 176, 176' and 178, 178' are formed.

Figure 33:
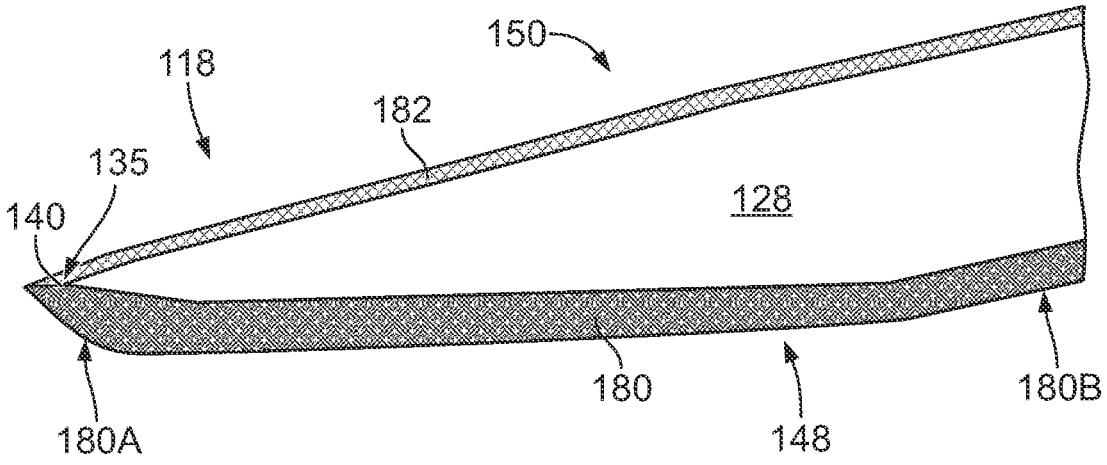

With reference to FIG. 33, in further embodiments, a difference between a first and a second coating 180 and 182 may be an outer shape. The first and second coatings 180 and 182 may extend from a tip region 135 toward the base (not shown) along a respective first or second outer side 148 or 150 of a substrate 128. An outer shape of the first coating 180 may comprise a first outer shape, and an outer shape of the second coating 182 may comprise a second outer shape that is different from the first outer shape. As shown in FIG. 33, the second coating 182 may substantially conform to and/or mirror a shape of one or more underlying portions of the substrate 128 on which the second coating 182 is formed, such that the outer shape of the second coating 182 is substantially similar to an outer shape of the underlying portion(s) of the substrate 128, e.g., the outer shape of the second and fourth facet outer surfaces 139B and 139D and the second blade body outer surface 131B (see FIG. 18). The first coating 180 may comprise at least one section that does not conform to a shape of one or more underlying portions of the substrate 128 on which the first coating 180 is formed. For example, with reference to FIGS. 18 and 33, the first coating 180 may comprise a thickened section 180A where the first coating 180 bulges outward from the substrate 128 and forms an outer shape that is different from an outer shape of one or more of the underlying portions of the substrate 128, e.g., the first and third facet outer surfaces 139A and 139C. The first coating 180 may optionally comprise a second section 180B with an outer shape that conforms more closely to the outer shape of the underlying portion(s), e.g., the first blade body outer surface 131A, of the substrate 128.

FIGS. 34-37 are detailed views of a tip region 35 of a substrate 28, which may represent any of the substrates 28 and 128 in FIGS. 4-17 and 20-33. In all examples described herein, a first coating 60 (and/or layers thereof) may adjoin and contact at least a portion of a second coating 62 (and/or layers thereof) at the tip region 35 of the substrate 28. FIG. 34 depicts an idealized representation of an interface 84 between the first and second coatings 60 and 62, in which the first coating 60 is located only on the first outer side 48 of the substrate 28, i.e., on the left side of a split line $S_{28}$ of the substrate 28, and the second coating 62 is located only on the second outer side 50, i.e., on the right side of a split line $S_{28}$.

Figure 35:
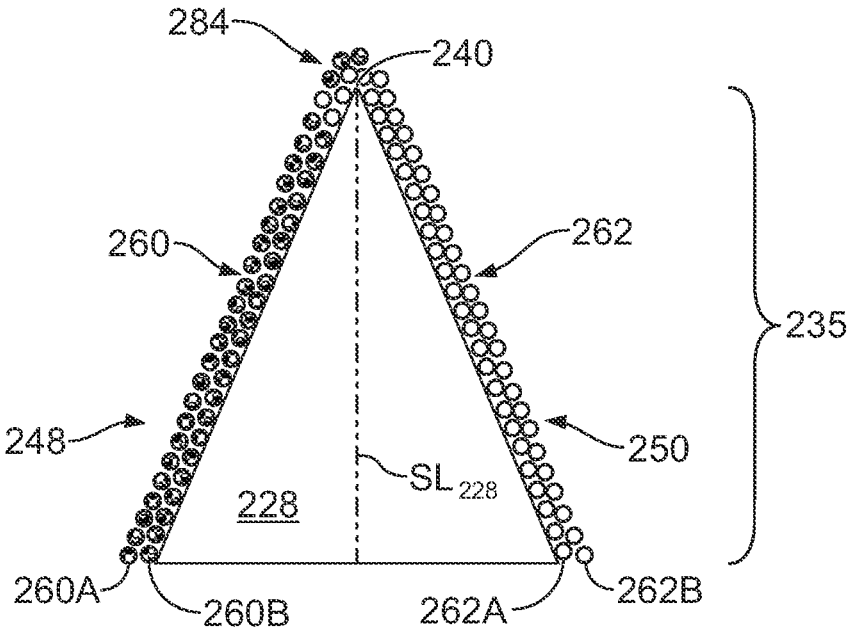
FIGS. 35, 36 and 37 are additional detailed side views similar to FIG. 34 of tip regions of razor blades comprising one or more coatings in accordance with the present disclosure.
Figure 36:
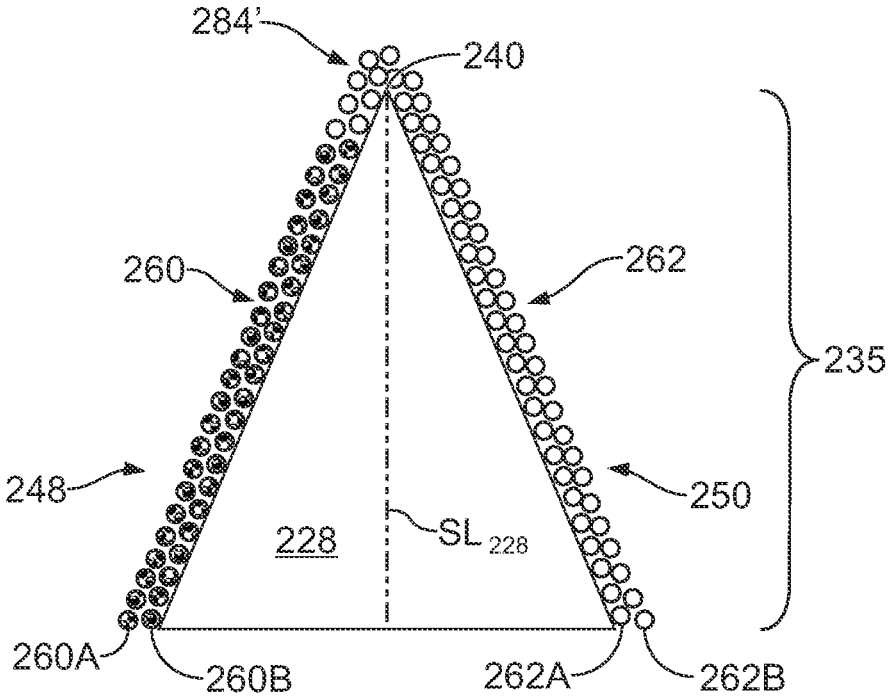
Figure 37:
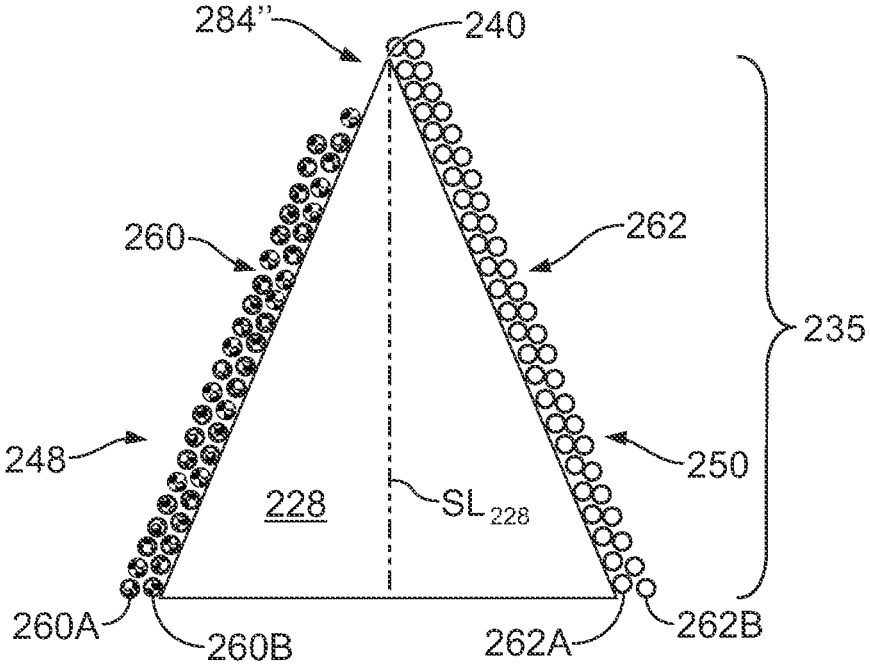

However, application of material(s) to the substrate 28 may produce a slightly imperfect interface 284, 284', and 284", as illustrated in FIGS. 35-37. In FIGS. 35-37, a first outer side 248 of a substrate 228 (as defined by a split line $SL_{228}$) may comprise a first coating 260 (represented by filled circles) with a first layer 260A and a second layer 260B, and a second outer side 250 of the substrate 228 may comprise a second coating 262 (represented by open circles) with a third layer 262A and a fourth layer 262B. As shown in FIG. 35, in some examples, a small portion of the second coating 262 (may include one or both of the third and fourth layers 262A and 262B) may be disposed on the first outer side 248 of the substrate 228 at the interface 284 of the first and second coatings 260 and 262, i.e., a small portion (extending less than or equal to about 1 μM back from the tip 240 toward the base) of the second coating 262 may be located to the left of the split line $SL_{228}$. Alternatively or in addition, a small portion of the first coating 260 (may include one or both of the first and second layers 260A and 260B) may be disposed on the second outer side 250 of the substrate 228, i.e., a small portion (extending less than or equal to about 1 μM back from the tip 240 toward the base) of the first coating 260 may be located to the right of the split line $SL_{228}$. FIG. 36 provides another example in which a slightly larger portion of the second coating 262 is disposed on the first outer side 248 of the substrate 228 at the interface 284'. FIG. 37 provides a further example in which one or both of the first and second coatings 260 and 262 stop slightly short of the tip 240. As shown, the second coating 262 extends up to about the tip 240, but the first coating 260 stops slightly short of the tip 240, such that there is a small gap (less than or equal to about 1 μM) between the first and second coatings 260 and 262.

Thus, the tip region 235 may comprise interfaces 284 and 284' that include a small amount of mixing between the first and second coatings 260 and 262 and an interface 284" in which one or both of the coatings 260 and/or 262 stop slightly short of the tip 240. In the examples described herein, notwithstanding a small amount (extending less than or equal to about 1 μM back from the tip 240 toward the base) of overlap or mixing of the first and second coatings and/or gaps (less than or equal to about 1 μM) in one or both of the coatings in the tip region, the first coating, including all layers thereof, is considered to be disposed "substantially" on the first outer side of the substrate and to extend "from the tip region" when the majority of the first coating is disposed on the first outer side of the substrate; and the second coating, including all layers thereof, may be considered to be disposed "substantially" on the second outer side of the substrate and to extend "from the tip region" when the majority of the second coating is disposed on the second outer side of the substrate.

In examples in which the first and/or second coating comprise two or more sections (see, for example, FIGS. 9-13 and 25-29), each section extends from one point or location to another point or location on the substrate and may adjoin and contact at least a portion of an adjacent section on the same outer side of the substrate. For example, as described herein in detail with respect to FIG. 9, the first section 72-1 of the first coating 72 extends along the first outer side 48 substantially between first and second locations 73-1 and 73-2 and second section 72-2 extends substantially between the second location 73-2 and a third location 73-3 on the first outer side 48. Thus, the first and second sections 72-1 and 72-2 in FIG. 9 adjoin and/or contact each other at an interface (not labeled) defined at the second location 73-2, in which the second location 73-2 is positioned at or near the first junction 39-1 between the first facet 38A and the blade body 30 (see FIG. 4). Similar to the structures depicted in FIGS. 35 and 36, the interface at the second location 73-2 may be slightly imperfect and may include a small amount (extending less than or equal to about 1 μM back from the tip 40 toward the base 32) of overlap and/or mixing of the material(s) comprising the two adjoining sections, e.g., a small portion of the first section 72-1 in FIG. 9 may extend past the junction 39-1 and onto the blade body 30 and/or a small portion of the second section 72-2 may extend past the junction 39-1 and onto the first facet 38A. Similar to the structure depicted in FIG. 37, there may be a small gap (less than or equal to about 1 μM) between the material(s) comprising the two adjoining sections. In the examples described herein, each section may be considered to extend "substantially" from one location to another location when the majority of the section is disposed between the two identified locations, notwithstanding a small amount of overlap or mixing of material(s) from adjacent sections at the interface between the sections and/or a small gap between the material(s) comprising the two adjoining sections.

As described in detail herein, the points or locations on the substrate may comprise a junction between adjacent ones of the facets or a junction between the blade body and one of the facets. Each coating/layer may be considered to be disposed "substantially" on one or more of the facets when the majority of the coating/layer is disposed on the identified facet(s), notwithstanding small areas (less than or equal to about 1 μM) of the coating/layer that stop slightly short of, or extend slightly past, an identified junction between adjacent facets or between the blade body and a facet.

Figure 38:
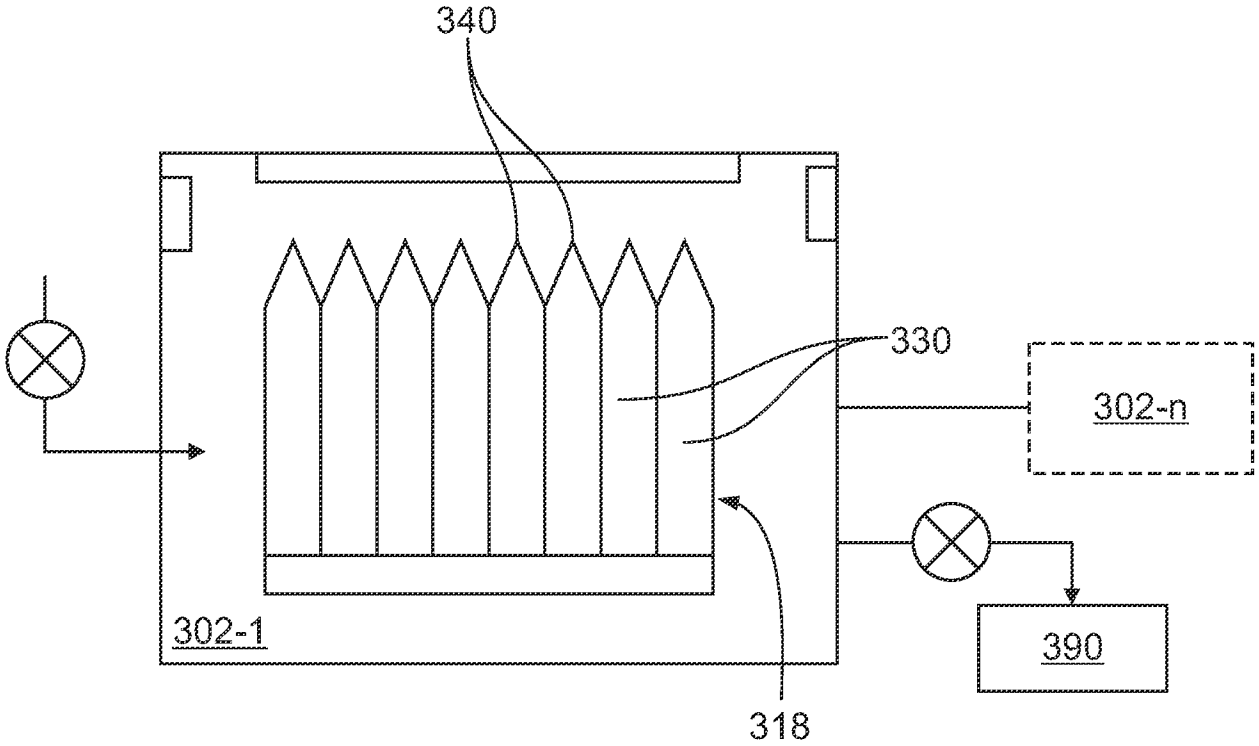
FIG. 38 is a schematic of a chamber showing razor blades capable of being coated via a deposition technique in accordance with the present disclosure.

The coatings described herein may be applied or selectively removed using one more techniques. FIG. 38 is a block diagram of a system 300 having one or more chambers and/or stations 302-1 to **302-*n* that may be used to apply one or more coatings to one or more portions of a plurality of razor blades 318 and/or to perform one or more post-application treatments following application of the one or more coatings. As shown, the razor blades 318 may be positioned within a first chamber 302-1 for application of one or more coatings using one or more techniques, such as vacuum deposition, spraying, dipping, brushing, molding, sintering, printing, etching, application via a pad or paint, ink-jet nozzle, or any combination thereof, any of which may or may not include masking one or more portions of the razor blades 318. In some examples, the chamber 302-1 may comprise a vacuum chamber with a vacuum pump 390. The system 300 may optionally comprise one or more additional chambers 302-*n*** for performing different coating techniques and/or to perform different post-application treatments.

The razor blades 318 may represent any razor blade described herein. The razor blades 318 may be arranged in any manner within the chamber 302-1. As shown, the razor blades 318 may be positioned adjacent to each other in an arrangement that may be referred to as a razor blade spindle. The blades 318 may also be disposed with a space in between each other (not shown) using spacers, which may allow coating coverage onto the blade bodies 330 of the razor blades 318 to be increased. The blades 318 may also be disposed with the edges (not labeled) and tips 340 facing in opposite directions or at different angles from each other (not shown). Any feasible orientation of the razor blades 318 is contemplated in the present disclosure.

The system 300 may be used to apply coatings to a razor blade, in which the razor blade comprises a substrate with first and second outer sides disposed opposite a split line. First and second coatings are applied to at least a portion of the first and second outer sides, with the first and second coatings extending from a tip region of the substrate toward a base and being disposed substantially on the respective first or second outer side. The coatings may each comprise one or more layers.

The system 300 may be configured to accommodate the application of multiple different kinds of materials, as described herein, including metals, fluorinated polymers, etc. The first and second coatings may be applied simultaneously or sequentially and may be applied using the same or different technique. In some examples, selective application of one or more materials may be accomplished by, for example, masking one or more portions of the substrate and applying the material(s) to the unmasked portion(s) of the substrate. The system 300 may also be configured to apply the first and second coatings to generate one or more desired properties for each coating, including a particular thickness, outer shape, morphology, texture, etc., as described herein. The system 300 may further be configured to perform one or more post-application treatments on at least one section of the first coating or the second coating, including ion implantation and/or altering a texture of the coating(s).

Figure 39:
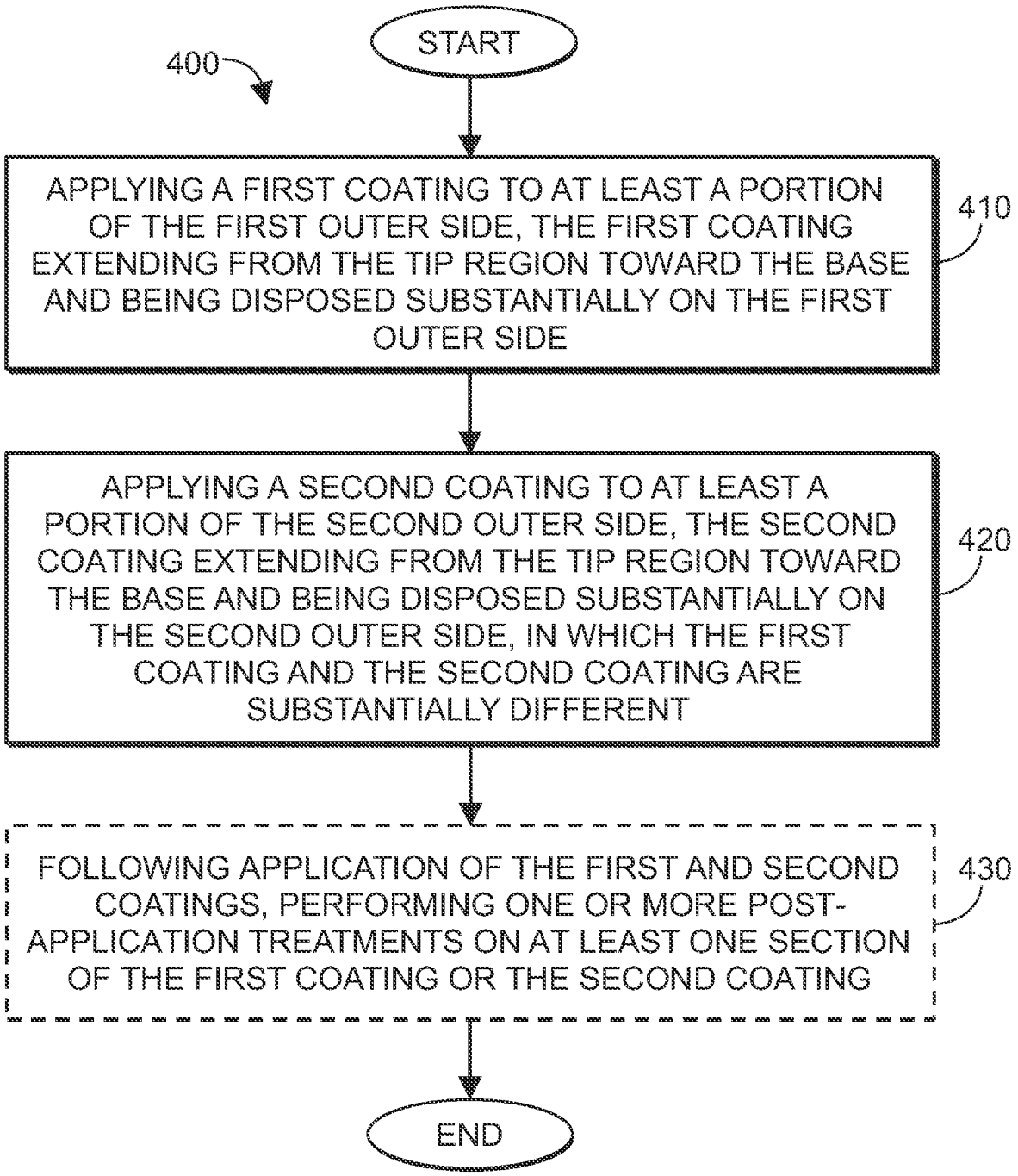
FIG. 39 is a flow diagram illustrating an exemplary method of coating a razor blade in accordance with the present disclosure.

FIG. 39 is a flow diagram illustrating an exemplary method 400 of coating a razor blade in accordance with the present disclosure. With reference to FIGS. 4 and 18, the razor blades 18, 118 may comprise a substrate 28, 128 having a tip portion 34, 134 comprising a tip region 35, 135, a blade body 30, 130 comprising a base 32, 132, and first and second outer sides 48, 148 and 50, 150 disposed opposite a split line $SL_{28}$, $SL_{128}$ of the substrate 28, 128, in which the first and second outer sides 48, 148 and 50, 150 converge at a tip 40, 140 to define a cutting edge 42. The method 400 begins with applying a first coating to at least a portion of the first outer side, at Step 410, in which the first coating extends from the tip region toward the base and is disposed substantially on the first outer side. At Step 420, a second coating is applied to at least a portion of the second outer side, after which the method may conclude. The second coating extends from the tip region toward the base and is disposed substantially on the second outer side. The first coating and the second coating are substantially different, as described herein in detail.

In some examples, the first coating comprises one or more first materials and the second coating comprises one or more second materials, in which at least one of the second materials may be different from at least one of the first materials.

In other examples, the first coating may be applied such that the first coating comprises a first thickness and the second coating may be applied such that the second coating comprises a second thickness that is different from the first thickness. The first and second thicknesses may be substantially constant in a direction extending from the tip region toward the base of the razor blade, or the first thickness may vary along at least a section of the first coating in a direction extending from the tip region toward the base of the razor blade and the second thickness may be substantially constant.

The first and second coatings may be applied simultaneously or sequentially. The first and second coatings may be applied using a same technique or via different techniques.

In some examples, the first coating may be applied such that the first coating comprises a first morphology and the second coating may be applied such that the second coating comprises a second morphology that is different from the first morphology. The first morphology may comprise a first microstructure and the second morphology may comprise a second microstructure.

In other examples, the first coating may be applied such that the first coating comprises a first texture and the second coating may be applied such that the second coating comprises a second texture that is different from the first texture. In further examples, the first coating may be applied such that the first coating comprises a first outer shape and the second coating may be applied such that the second coating comprises a second outer shape that is different from the first outer shape.

As shown in FIGS. 4 and 18, the tip portion 34, 134 of the substrate 28, 128 may comprise a first flank 36A, 136A defined by a portion of the first outer side 48, 148 and a second flank 36B, 136B defined by a portion of the second outer side 50, 150. The first flank 36A, 136A may comprise one or more first facets 38A, 138A and/or 38C, 138C and the second flank 36B, 136B comprising one or more second facets 38B, 138B and/or 38D, 138D, in which the first and second flanks 36A, 136A and 36B, 136B may converge at the tip 40, 140. In some examples, applying the first coating and/or applying the second coatings may comprise: applying the first coating to at least a portion of at least one of the first facets; or applying the second coating to at least a portion of at least one of the second facets.

In other examples, applying the first coating may comprise: applying a first section of the first coating, in which the first section may extend substantially from a first location to a second location on the first outer side; and applying a second section of the first coating, in which the second section may extend substantially from the second location to a third location on the first outer side. The first section of the first coating may be substantially different from the second section, with the first location comprising the tip region and the second location comprising a junction between: (i) two adjacent ones of the first facets, or (ii) the blade body and one of the first facets. Applying the second coating may comprise: applying a third section of the second coating, in which the third section may extend substantially from a fourth location to a fifth location on the second outer side; and applying a fourth section of the second coating, in which the fourth section may extend substantially from the fifth location to a sixth location on the second outer side. The third section of the second coating may be substantially different from the fourth section, with the fourth location comprising the tip region and the fifth location comprising a junction between (i) two adjacent ones of the second facets, or (ii) the blade body and one of the second facets.

In further examples, applying the first coating may comprise applying a first section and a second section, in which the first section may extend substantially from a first location at the tip region to a second location on the first outer side and the second section may extend substantially from the second location to a third location on the first outer side, in which the first section may be substantially different from the second section. Applying the second coating may comprise applying a third section and a fourth section, in which the third section may extend substantially from a fourth location at the tip region to a fifth location on the second outer side and the fourth section may extend substantially from the fifth location to a sixth location on the second outer side, in which the third section may be substantially different from the fourth section.

In yet further examples, the first coating may be applied such that the first coating extends along the first outer side from the tip region toward the base for a first distance and the second coating may be applied such that the second coating extends along the second outer side from the tip region toward the base for a second distance that is different from the first distance.

The method 400 may include the optional Step 430 of performing one or more post-application treatments on at least one section of the first coating or the second coating, following application of the first and second coatings, after which the method may conclude.

In some examples, the at least one section of the first or the second coating may comprise at least one of the first facets or the second facets.

In some instances, the one or more post-application treatments may comprise subjecting at least one section of at least one of the first or the second coating to ion implantation.

In other instances, the one or more post-application treatments may comprise altering a texture of at least one of the first or the second coating.

In further instances, the one or more post-application treatments may comprise partially removing one or more portions of at least one of the first or the second coating. In some examples, the one or more post-application treatments may comprise selectively applying material to the first or the second coating following partial removal of the first or the second coating. The selectively-applied material may comprise a polymer or organic compound. At least a portion of the first or the second outer side with the selectively-applied material may define a skin-contacting surface.

Representative embodiments of the present disclosure described above can be described as follows:

A. A razor blade comprising:

a substrate having a tip portion comprising a tip region, a blade body comprising a base, and first and second outer sides disposed opposite a split line of the substrate, wherein the first and second outer sides converge at a tip;

a first coating disposed substantially on the first outer side and extending from the tip region toward the base; and a second coating disposed substantially on the second outer side and extending from the tip region toward the base, wherein the first coating and the second coating are substantially different.

B. The razor blade of paragraph A, wherein the first coating comprises one or more first materials and the second coating comprises one or more second materials, at least one of the second materials being different from at least one of the first materials.

C. The razor blade of paragraph B, wherein at least one of the first or the second materials comprises DLC, amorphous diamond, or nano-crystalline diamond.

D. The razor blade of paragraph B, wherein the one or more first materials comprise a metal and the one or more second materials comprise a ceramic.

E. The razor blade of paragraph B, wherein the one or more first and second materials are selected from platinum chromium, chromium nitride, chromium carbide, and a nanocomposite.

F. The razor blade of any of paragraphs A to E, wherein the first coating comprises a first thickness and the second coating comprises a second thickness that is different from the first thickness.

G. The razor blade of paragraph F, wherein the first and second thicknesses are substantially constant in a direction extending from the tip region toward the base of the razor blade.

H The razor blade of paragraph F, wherein the first thickness varies along at least a section of the first coating in a direction extending from the tip region toward the base of the razor blade and the second thickness is substantially constant.

I. The razor blade of any of paragraphs A to H, wherein at least one of the first coating or the second coating comprises an ion-implanted material.

J. The razor blade of paragraph I, wherein the ion-implanted material comprises at least one of a plasma-nitrided material or a plasma-borided material.

K. The razor blade of any of any of paragraphs A to J, wherein the first coating comprises a first material with a first coefficient of friction and the second coating comprises a second material with a second coefficient of friction that is different from the first coefficient of friction.

L. The razor blade of paragraph K, wherein the first coating comprises a fluorinated polymer and the second coating comprises a polyolefin.

M. The razor blade of paragraph L, wherein the fluorinated polymer comprises polytetrafluoroethylene and the polyolefin comprises polypropylene.

N. The razor blade of paragraph K, wherein the one or more first materials comprise polytetrafluoroethylene and the one or more second materials lack polytetrafluoroethylene.

O. The razor blade of any of any of paragraphs A to N, wherein the first coating comprises a first morphology and the second coating comprises a second morphology that is different from the first morphology.

P. The razor blade of paragraph O, wherein the first morphology comprises a first microstructure and the second morphology comprises a second microstructure.

Q. The razor blade of any of any of paragraphs A to P, wherein the first coating comprises a first texture and the second coating comprises a second texture that is different from the first texture.

R. The razor blade of any of paragraphs A to Q, wherein the first coating comprises a first hardness and the second coating comprises a second hardness that is different from the first hardness.

S. The razor blade of paragraph R, wherein the first hardness is greater than about 7 GPa and the second hardness is greater than about twice the first hardness.

T. The razor blade of any of paragraphs A to S, wherein at least a portion of one of the first or the second outer side defines a skin-contacting surface.

U. The razor blade of any of paragraphs A to T, wherein the first coating defines a first outer shape and the second coating defines a second outer shape that is different from the first outer shape.

V. The razor blade of any of paragraphs A to U, wherein the split line splits the substrate into two substantially equal halves.

W. The razor blade of any of paragraphs A to U, wherein the split line splits the substrate into two asymmetrical halves.

X. The razor blade of any of paragraphs A to W, wherein the tip portion of the substrate comprises a first flank defined by a portion of the first outer side and a second flank defined by a portion of the second outer side, the first flank comprising one or more first facets and the second flank comprising one or more second facets, the first and second flanks converging at the tip.

Y. The razor blade of paragraph X, comprising at least one of:

the first coating being disposed substantially on at least one of the first facets; or the second coating being disposed substantially on at least one of the second facets.

Z. The razor blade of paragraph X, wherein the first coating comprises:

a first section extending substantially from a first location to a second location on the first outer side; and a second section extending substantially from the second location to a third location on the first outer side, the first section being substantially different from the second section, wherein the first location comprises the tip region and the second location comprises a junction between (i) two adjacent ones of the first facets, or (ii) the blade body and one of the first facets.

AA. The razor blade of paragraph Z, wherein the second coating comprises:

a third section extending substantially from a fourth location to a fifth location on the second outer side; and a fourth section extending substantially from the fifth location to a sixth location on the second outer side, the third section being substantially different from the fourth section, wherein the fourth location comprises the tip region and the fifth location comprises a junction between (i) two adjacent ones of the second facets, or (ii) the blade body and one of the second facets.

BB. The razor blade of paragraph X, wherein:

the first coating comprises a first section extending substantially from a first location at the tip region to a second location on the first outer side and a second section extending substantially from the second location to a third location on the first outer side, the first section being substantially different from the second section; and the second coating comprises a third section extending substantially from a fourth location at the tip region to a fifth location on the second outer side and a fourth section extending substantially from the fifth location to a sixth location on the second outer side, the third section being substantially different from the fourth section.

CC. The razor blade of any of paragraphs A to Y, wherein the first coating extends along a portion of the first outer side from the tip region toward the base for a first distance and the second coating extends along a portion of the second outer side from the tip region toward the base for a second distance that is different from the first distance.

DD. A method of coating a razor blade comprising a substrate having a tip portion comprising a tip region, a blade body comprising a base, and first and second outer sides disposed opposite a split line of the substrate, wherein the first and second outer sides converge at a tip to define, the method comprising:

applying a first coating to a portion of the first outer side, the first coating extending from the tip region toward the base and being disposed substantially on the first outer side; and applying a second coating to a portion of the second outer side, the second coating extending from the tip region toward the base and being disposed substantially on the second outer side, wherein the first coating and the second coating are substantially different.

EE. The method of paragraph DD, wherein the first coating comprises one or more first materials and the second coating comprises one or more second materials, at least one of the second materials being different from at least one of the first materials.

FF. The method of paragraph DD or EE, wherein the first coating is applied such that the first coating comprises a first thickness and the second coating is applied such that the second coating comprises a second thickness that is different from the first thickness.

GG. The method of paragraph FF, wherein the first and second thicknesses are substantially constant in a direction extending from the tip region toward the base of the razor blade.

HH. The method of paragraph FF, wherein the first thickness varies along at least a section of the first coating in a direction extending from the tip region toward the base of the razor blade and the second thickness is substantially constant.

II. The method of any of paragraphs DD to HH, wherein the first and second coatings are applied simultaneously.

JJ. The method of any of paragraphs DD to HH, wherein the first and second coatings are applied sequentially.

KK. The method of any of paragraphs DD to JJ, wherein the first and second coatings are applied using a same technique.

LL. The method of any of paragraphs DD to JJ, wherein the first coating is applied with a first technique and the second coating is applied with a second technique that is different from the first technique.

MM. The method of any of paragraphs DD to LL, wherein the first coating is applied such that the first coating comprises a first morphology and the second coating is applied such that the second coating comprises a second morphology that is different from the first morphology.

NN. The method of paragraph MM, wherein the first morphology comprises a first microstructure and the second morphology comprises a second microstructure.

OO. The method of any of paragraphs DD to NN, wherein the first coating is applied such that the first coating comprises a first texture and the second coating is applied such that the second coating comprises a second texture that is different from the first texture.

PP. The method of any of paragraphs DD to OO, wherein the first coating is applied such that the first coating comprises a first outer shape and the second coating is applied such that the second coating comprises a second outer shape that is different from the first outer shape.

QQ. The method of any of paragraphs DD to PP, wherein the tip portion of the substrate comprises a first flank defined by a portion of the first outer side and a second flank defined by a portion of the second outer side, the first flank comprising one or more first facets and the second flank comprising one or more second facets, the first and second flanks converging at the tip, and wherein at least one of applying the first coating or applying the second coating comprises:

applying the first coating to at least a portion of at least one of the first facets; or applying the second coating to at least a portion of at least one of the second facets.

RR. The method of any of paragraphs DD to PP, wherein the tip portion of the substrate comprises a first flank defined by a portion of the first outer side and a second flank defined by a portion of the second outer side, the first flank comprising one or more first facets and the second flank comprising one or more second facets, the first and second flanks converging at the tip, and wherein applying the first coating comprises:

applying a first section of the first coating, the first section extending substantially from a first location to a second location on the first outer side; and applying a second section of the first coating, the second section extending substantially from the second location to a third location on the first outer side, wherein the first section is substantially different from the second section, wherein the first location comprises the tip region and the second location comprises a junction between (i) two adjacent ones of the first facets, or (ii) the blade body and one of the first facets.

SS. The method of paragraph RR, wherein applying the second coating comprises:

applying a third section of the second coating, the third section extending substantially from a fourth location to a fifth location on the second outer side; and applying a fourth section of the second coating, the fourth section extending substantially from the fifth location to a sixth location on the second outer side, wherein the third section is substantially different from the fourth section, wherein the fourth location comprises the tip region and the fifth location comprises a junction between (i) two adjacent ones of the second facets, or (ii) the blade body and one of the second facets.

TT. The method of any of paragraphs DD to PP, wherein:

the tip portion of the substrate comprises a first flank defined by a portion of the first outer side and a second flank defined by a portion of the second outer side, the first flank comprising one or more first facets and the second flank comprising one or more second facets, the first and second flanks converging at the tip;

applying the first coating comprises applying a first section and a second section, wherein the first section extends substantially from a first location at the tip region to a second location on the first outer side and the second section extends substantially from the second location to a third location on the first outer side, the first section being substantially different from the second section; and applying the second coating comprises applying a third section and a fourth section, wherein the third section extends substantially from a fourth location at the tip region to a fifth location on the second outer side and the fourth section extends substantially from the fifth location to a sixth location on the second outer side, the third section being substantially different from the fourth section.

UU. The method of any of paragraphs DD to PP, wherein the first coating is applied such that the first coating extends along the first outer side from the tip region toward the base for a first distance and the second coating is applied such that the second coating extends along the second outer side from the tip region toward the base for a second distance that is different from the first distance.

VV. The method of any of paragraphs DD to UU, further comprising:

following application of the first and second coatings, performing one or more post-application treatments on at least one section of the first coating or the second coating.

WW. The method of paragraph VV, wherein the tip portion of the substrate comprises a first flank defined by a portion of the first outer side and a second flank defined by a portion of the second outer side, the first flank comprising one or more first facets and the second flank comprising one or more second facets, the first and second flanks converging at the tip, wherein the at least one section of the first or the second coating comprises at least one of the first facets or the second facets.

XX. The method of paragraph VV or WW, wherein the one or more post-application treatments comprise subjecting at least one section of at least one of the first or the second coating to ion implantation.

YY. The method of any of paragraphs VV to XX, wherein the one or more post-application treatments comprise altering a texture of at least one of the first or the second coating.

ZZ. The method of any of paragraphs VV to YY, wherein the one or more post-application treatments comprise partially removing one or more sections of at least one of the first or the second coating.

AAA. The method of paragraph ZZ, wherein the one or more post-application treatments further comprise selectively applying material to the first or the second coating following partial removal of the one or more sections of the first or the second coating.

BBB. The method of paragraph AAA, wherein the material comprises a polymer or organic compound.

CCC. The method of paragraph BBB, wherein at least a portion of the first or the second outer side with the material defines a skin-contacting surface.

The illustrations presented herein are not intended to be actual views of any particular substrate, apparatus (e.g., device, system, etc.), or method, but are merely idealized and/or schematic representations that are employed to describe and illustrate various embodiments of the disclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge having a razor blade for cutting hair, the razor blade comprising:

a substrate having a tip portion comprising a tip region, a blade body comprising a base, and first and second outer sides disposed opposite a split line of said substrate, wherein said first and second outer sides converge at a tip;

a first coating disposed on said first outer side and extending from said tip region toward said base, said first coating having a hardness greater than 7 gigapascals; and a second coating disposed on said second outer side and extending from said tip region toward said base, wherein said first coating and said second coating are different, said first coating comprises one or more first materials and said second coating comprises one or more second materials, at least one of said second materials being different from at least one of said first materials for lowering cutting force, the hardness of said first coating being less than a hardness of said second coating and wherein the hardness of the second coating is greater than 15 gigapascals.

2. The razor cartridge of claim 1, wherein at least one of said first or said second materials comprises diamond like carbon (DLC), amorphous diamond, or nano-crystalline diamond.

3. The razor cartridge of claim 1, wherein said one or more first materials comprise a metal and said one or more second materials comprise a ceramic.

4. The razor cartridge of claim 1, wherein said one or more first and second materials are selected from platinum chromium, chromium nitride, chromium carbide, and a nanocomposite.

5. The razor cartridge of claim 1, wherein said first coating comprises a first thickness and said second coating comprises a second thickness that is different from said first thickness.

6. The razor cartridge of claim 5, wherein said first and second thicknesses are constant in a direction extending from said tip region toward said base of said razor blade.

7. The razor cartridge of claim 5, wherein said first thickness varies along at least a section of said first coating in a direction extending from said tip region toward said base of said razor blade and said second thickness is constant.

8. The razor cartridge of claim 1, wherein at least one of said first coating or said second coating comprises an ion-implanted material.

9. The razor cartridge of claim 8, wherein said ion-implanted material comprises at least one of a plasma-nitrided material or a plasma-borided material.

10. The razor cartridge of claim 1, wherein said first coating comprises a first material with a first coefficient of friction and said second coating comprises a second material with a second coefficient of friction that is different from said first coefficient of friction.

11. The razor cartridge of claim 10, wherein said first coating comprises a fluorinated polymer and said second coating comprises a polyolefin.

12. The razor cartridge of claim 11, wherein said fluorinated polymer comprises polytetrafluoroethylene and said polyolefin comprises polypropylene.

13. The razor cartridge of claim 10, wherein said one or more first materials comprise polytetrafluoroethylene and said one or more second materials lack polytetrafluoroethylene.

14. The razor cartridge of claim 1, wherein said first coating comprises a first morphology and said second coating comprises a second morphology that is different from said first morphology.

15. The razor cartridge of claim 14, wherein said first morphology comprises a first microstructure and said second morphology comprises a second microstructure.

16. The razor cartridge of claim 1, wherein said first coating comprises a first texture and said second coating comprises a second texture that is different from said first texture.

17. The razor cartridge of claim 1, wherein at least a portion of one of said first or said second outer sides defines a skin-contacting surface.

18. The razor cartridge of claim 1, wherein said first coating defines a first outer shape and said second coating defines a second outer shape that is different from said first outer shape.

19. The razor cartridge of claim 1, wherein said split line splits said substrate into two equal halves.

20. The razor cartridge of claim 1, wherein said split line splits said substrate into two asymmetrical halves.

21. The razor cartridge of claim 1, wherein said tip portion of said substrate comprises a first flank defined by a portion of said first outer side and a second flank defined by a portion of said second outer side, said first flank comprising one or more first facets and said second flank comprising one or more second facets, said first and second flanks converging at said tip.

22. The razor cartridge of claim 21, comprising at least one of:

said first coating being disposed on at least one of said first facets; or said second coating being disposed on at least one of said second facets.

23. The razor cartridge of claim 21, wherein said first coating comprises:

a first section extending from a first location to a second location on said first outer side; and a second section extending from said second location to a third location on said first outer side, said first section being different from said second section, wherein said first location comprises said tip region and said second location comprises a junction between (i) two adjacent ones of said first facets, or (ii) said blade body and one of said first facets.

24. The razor cartridge of claim 23, wherein said second coating comprises:

a third section extending from a fourth location to a fifth location on said second outer side; and a fourth section extending from said fifth location to a sixth location on said second outer side, said third section being different from said fourth section, wherein said fourth location comprises said tip region and said fifth location comprises a junction between (i) two adjacent ones of said second facets, or (ii) said blade body and one of said second facets.

25. The razor cartridge of claim 21, wherein:

said first coating comprises a first section extending from a first location at said tip region to a second location on said first outer side and a second section extending from said second location to a third location on said first outer side, said first section being different from said second section; and said second coating comprises a third section extending from a fourth location at said tip region to a fifth location on said second outer side and a fourth section extending from said fifth location to a sixth location on said second outer side, said third section being different from said fourth section.

26. The razor cartridge of claim 1, wherein said first coating extends along a portion of said first outer side from said tip region toward said base for a first distance and said second coating extends along a portion of said second outer side from said tip region toward said base for a second distance that is different from said first distance.

27. A method of coating a razor blade for cutting hair comprising a substrate having a tip portion comprising a tip region, a blade body comprising a base, and first and second outer sides disposed opposite a split line of said substrate, wherein said first and second outer sides converge at a tip, the method comprising:

applying a first coating to a portion of said first outer side, said first coating extending from said tip region toward said base and being disposed on said first outer side; and applying a second coating to a portion of said second outer side, said second coating extending from said tip region toward said base and being disposed on said second outer side, wherein said first coating and said second coating are different, said first coating having a hardness greater than 7 gigapascals, said first coating comprises one or more first materials and said second coating comprises one or more second materials, at least one of said second materials being different from at least one of said first materials for lowering cutting force, the hardness of said first coating being less than a hardness of said second coating and wherein the hardness of the second coating is greater than 15 gigapascals.

28. The method of claim 27, wherein said first coating is applied such that said first coating comprises a first thickness and said second coating is applied such that said second coating comprises a second thickness that is different from said first thickness.

29. The method of claim 28, wherein said first and second thicknesses are constant in a direction extending from said tip region toward said base of said razor blade.

30. The method of claim 28, wherein said first thickness varies along at least a section of said first coating in a direction extending from said tip region toward said base of said razor blade and said second thickness is constant.

31. The method of claim 27, wherein said first and second coatings are applied simultaneously.

32. The method of claim 27, wherein said first and second coatings are applied sequentially.

33. The method of claim 27, wherein said first and second coatings are applied using a same technique.

34. The method of claim 27, wherein said first coating is applied with a first technique and said second coating is applied with a second technique that is different from said first technique.

35. The method of claim 27, wherein said first coating is applied such that said first coating comprises a first morphology and said second coating is applied such that said second coating comprises a second morphology that is different from said first morphology.

36. The method of claim 35, wherein said first morphology comprises a first microstructure and said second morphology comprises a second microstructure.

37. The method of claim 27, wherein said first coating is applied such that said first coating comprises a first texture and said second coating is applied such that said second coating comprises a second texture that is different from said first texture.

38. The method of claim 27, wherein said first coating is applied such that said first coating comprises a first outer shape and said second coating is applied such that said second coating comprises a second outer shape that is different from said first outer shape.

39. The method of claim 27, wherein said tip portion of said substrate comprises a first flank defined by a portion of said first outer side and a second flank defined by a portion of said second outer side, said first flank comprising one or more first facets and said second flank comprising one or more second facets, said first and second flanks converging at said tip, and wherein at least one of applying said first coating or applying said second coatings comprises:

applying said first coating to at least a portion of at least one of said first facets; or applying said second coating to at least a portion of at least one of said second facets.

40. The method of claim 27, wherein said tip portion of said substrate comprises a first flank defined by a portion of said first outer side and a second flank defined by a portion of said second outer side, said first flank comprising one or more first facets and said second flank comprising one or more second facets, said first and second flanks converging at said tip, and wherein applying said first coating comprises:

applying a first section of said first coating, said first section extending from a first location to a second location on said first outer side; and applying a second section of said first coating, said second section extending from said second location to a third location on said first outer side, wherein said first section is different from said second section, wherein said first location comprises said tip region and said second location comprises a junction between (i) two adjacent ones of said first facets, or (ii) said blade body and one of said first facets.

41. The method of claim 40, wherein applying said second coating comprises:

applying a third section of said second coating, said third section extending from a fourth location to a fifth location on said second outer side; and applying a fourth section of said second coating, said fourth section extending from said fifth location to a sixth location on said second outer side, wherein said third section is different from said fourth section, wherein said fourth location comprises said tip region and said fifth location comprises a junction between (i) two adjacent ones of said second facets, or (ii) said blade body and one of said second facets.

42. The method of claim 27, wherein:

said tip portion of said substrate comprises a first flank defined by a portion of said first outer side and a second flank defined by a portion of said second outer side, said first flank comprising one or more first facets and said second flank comprising one or more second facets, said first and second flanks converging at said tip;

applying said first coating comprises applying a first section and a second section, wherein said first section extends from a first location at said tip region to a second location on said first outer side and said second section extends from said second location to a third location on said first outer side, said first section being different from said second section; and applying said second coating comprises applying a third section and a fourth section, wherein said third section extends from a fourth location at said tip region to a fifth location on said second outer side and said fourth section extends from said fifth location to a sixth location on said second outer side, said third section being different from said fourth section.

43. The method of claim 27, wherein said first coating is applied such that said first coating extends along said first outer side from said tip region toward said base for a first distance and said second coating is applied such that said second coating extends along said second outer side from said tip region toward said base for a second distance that is different from said first distance.

44. The method of claim 27, further comprising:

following application of said first and second coatings, performing one or more post-application treatments on at least one section of said first coating or said second coating.

45. The method of claim 44, wherein said tip portion of said substrate comprises a first flank defined by a portion of said first outer side and a second flank defined by a portion of said second outer side, said first flank comprising one or more first facets and said second flank comprising one or more second facets, said first and second flanks converging at said tip, wherein said at least one section of said first or said second coating comprises at least one of said first facets or said second facets.

46. The method of claim 44, wherein said one or more post-application treatments comprise subjecting at least one section of at least one of said first or said second coating to ion implantation.

47. The method of claim 44, wherein said one or more post-application treatments comprise altering a texture of at least one of said first or said second coating.

48. The method of claim 44, wherein said one or more post-application treatments comprise partially removing one or more sections of at least one of said first or said second coating.

49. The method of claim 48, wherein said one or more post-application treatments further comprise selectively applying material to said first or said second coating following partial removal of said one or more sections of first or said second coating.

50. The method of claim 49, wherein said material comprises a polymer or organic compound.

51. The method of claim 50, wherein at least a portion of said first or said second outer sides with said material defines a skin-contacting surface.

* * * * *